US012798915B2

(12) United States Patent
Gruner et al.

(10) Patent No.: US 12,798,915 B2
(45) Date of Patent: Nov. 17, 2026

(54) COIL REALIGNMENT AND UNTELESCOPING MACHINE

(71) Applicant: SOS Service, Inc., Angola, IN (US)

(72) Inventors: Troy Gruner, Coldwater, MI (US); Matt Pelletier, Fremont, IN (US)

(73) Assignee: SOS Service, Inc., Angola, IN (US)

( * ) Notice: Subject to any disclaimer, the term of this patent is extended or adjusted under 35 U.S.C. 154(b) by 48 days.

(21) Appl. No.: 19/003,384

(22) Filed: Dec. 27, 2024

(65) Prior Publication Data

US 2026/0184526 A1 Jul. 2, 2026

(51) Int. Cl.
*B65H 16/06* (2006.01)
*B21C 47/18* (2006.01)

(52) U.S. Cl.
CPC ..... *B65H 16/06* (2013.01); *B21C 47/18* (2013.01); *B65H 2701/511* (2013.01)

(58) Field of Classification Search
CPC .. B65H 16/06; B65H 75/241; B65H 75/2416; B21C 47/18
See application file for complete search history.

(56) References Cited

U.S. PATENT DOCUMENTS

| | | | | |
|---|---|---|---|---|
| 4,160,531 | A | 7/1979 | Van Gompel | |
| 4,234,136 | A * | 11/1980 | Wenzel | B65H 16/06 242/598.1 |
| 4,431,141 | A | 2/1984 | Schutz | |
| 5,704,564 | A * | 1/1998 | Neiderman | B65H 75/2495 242/537 |
| 10,246,285 | B2 * | 4/2019 | Howard | B65H 75/185 |
| 2007/0170301 | A1 | 7/2007 | Morello et al. | |
| 2011/0232203 | A1 | 9/2011 | Anderson et al. | |
| 2011/0233318 | A1 | 9/2011 | Anderson | |

* cited by examiner

*Primary Examiner* — Sang K Kim
(74) *Attorney, Agent, or Firm* — Connor Fleck; Barrett McNagny LLP

(57) ABSTRACT

A telescoped coil of sheet material comprises a plurality of wraps wound in concentric spirals around a central longitudinal axis, wherein one or more wraps have unraveled along the longitudinal axis. A machine for untelescoping a coil of sheet material comprises a first side wall, a second side wall, and one or more linear actuators. The side walls are disposed a distance apart from each other and the coil is received therebetween. The linear actuators are adapted to selectively drive one of the first and second side walls towards the other for thereby compressing the coil along its central longitudinal axis. As the coil is compressed, the unraveled coil wraps twist about the central longitudinal axis and coil radially inwardly, and one or both of the first and second side walls are configured twist about the central longitudinal axis together with the unraveled coil wraps.

20 Claims, 28 Drawing Sheets

COIL REALIGNMENT AND UNTELESCOPING MACHINE

BACKGROUND OF THE INVENTION

1. Field of the Invention

The present invention relates to sheet materials which are wound in cylindrical coils. More particularly, the present invention relates to sheet material coils comprising a plurality of wraps which are wound in concentric spirals around a central longitudinal axis, wherein one or more of the coil wraps have unraveled (or "telescoped") in a direction along the central longitudinal axis, and machines for longitudinally compressing and thereby "untelescoping" the coils.

2. Background

Sheet and plate materials, such as, for example, sheet and plate steel, sheet and plate aluminum, and other sheet and plate metal products, are commonly manufactured in long strips which are wound into cylindrical coils (also referred to as "rolls"). The coils comprise a plurality of overlapping wraps which are wound into concentric spirals around a central longitudinal axis. When sheet materials, and in particular high-tensile strength sheet materials such as, for example, sheet steel and sheet aluminum, are wound into coils, the wraps of the coil are subjected to internal compressive and tensile/expansive forces which resist the bending deformation of the sheet material. These internal forces cause the coil wraps to drive radially outwardly against adjacent surrounding wraps.

Winding these materials into coils reduces the space necessary for storage and makes the materials easier to transport, handle, and use. However, manufacturing defects, such as, for example, oscillation occurring while winding the coil, and/or impact forces experienced during transportation or handling can cause the overlapping wraps of the coil to slide or shift and become misaligned with each other. For example, oscillation and/or impact forces can cause the inner coil wraps to shift and unravel whereby the coil elongates along its central longitudinal axis. This type of misalignment is commonly referred to as "telescoping" and, when the coil wraps telescope, the internal compressive and tensile/expansive forces cause the telescoped wraps to unwind relative to the coil longitudinal axis.

Telescoped coils are significantly more difficult to transport, handle, and use. Accordingly, a need exists for a machine which longitudinally compresses and thereby "untelescopes" sheet material coils which have become telescoped during manufacturing, transportation, or handling thereof.

SUMMARY OF THE INVENTION

In one form thereof, the present invention is directed to a machine for untelescoping a coil of sheet material. The coil of sheet material comprises a plurality of wraps which are wound in concentric spirals around a central longitudinal axis, wherein one or more of the coil wraps have unraveled in a direction along the central longitudinal axis. The machine comprises a first side wall, a second side wall, and one or more linear actuators. The second side wall is disposed a distance from the first side wall and the coil is received therebetween. The linear actuators are adapted to selectively drive one of the first and second side walls towards the other for thereby compressing the coil along its central longitudinal axis. As the coil is compressed along its central longitudinal axis, the unraveled coil wraps twist about the central longitudinal axis and coil radially inwardly and one or both of the first and second side walls twist about the central longitudinal axis together with the unraveled coil wraps.

Preferably, the first and second side walls include one or more window openings. The linear actuators comprise rods which are slidably received through the window openings and extend between and couple the first and second side walls together. The linear actuators also comprise hollow hydraulic cylinders which are mounted on the rods and are configured to drive one of the side walls towards the other.

Preferably, the side walls further include planar face plate which are configured to engage the coil. The planar face plates are preferably constructed from a high-strength, abrasion resistant material. Yet more preferably, the side walls are frameworks constructed from a plurality of tubular members and the face plate is mounted to one or more of the tubular members. One or more of the tubular members preferably include one or more internal ribs for reinforcing and increasing the rigidity of said tubular member.

Preferably, the machine includes two or more hydraulic cylinders and one or more hydraulic manifolds which are coupled between the hydraulic cylinders and a hydraulic power source for distributing hydraulic fluid and hydraulic pressure between the hydraulic cylinders.

Preferably, the linear actuators are positioned relative to one or both of the first and second side walls and the position of the one or more linear actuators is selectively adjusted using winches mounted to one or both of the side walls.

Preferably, one or both of the first and second side walls include one or more feet which support the first and/or second side wall above the ground. The one or more feet are configured to slide along the ground whereby the first and/or second side wall can be slidably moved towards the other.

In another form, the present invention is directed to a method for untelescoping a coil of sheet material comprising a plurality of wraps which are wound in concentric spirals around a central longitudinal axis, wherein one or more of the coil wraps have unraveled in a direction along the central longitudinal axis. The method comprises the step of compressing the coil along its central longitudinal axis between a first side wall and a second side wall. As the coil is compressed, the unraveled coil wraps twist about the central longitudinal axis and coil radially inwardly and one or both of the first and second side walls twist about the central longitudinal axis together with the unraveled coil wraps.

Preferably, during the step of compressing, one or both of the first and second side walls pivot relative to one or more axes extending generally perpendicular to the central longitudinal axis.

BRIEF DESCRIPTION OF THE DRAWINGS

The above-mentioned and other features of this invention and the manner of attaining them will become more apparent, and the invention itself will be better understood by reference to the following description of the embodiments of the invention, taken in conjunction with the accompanying drawings, wherein.

Figure 1:
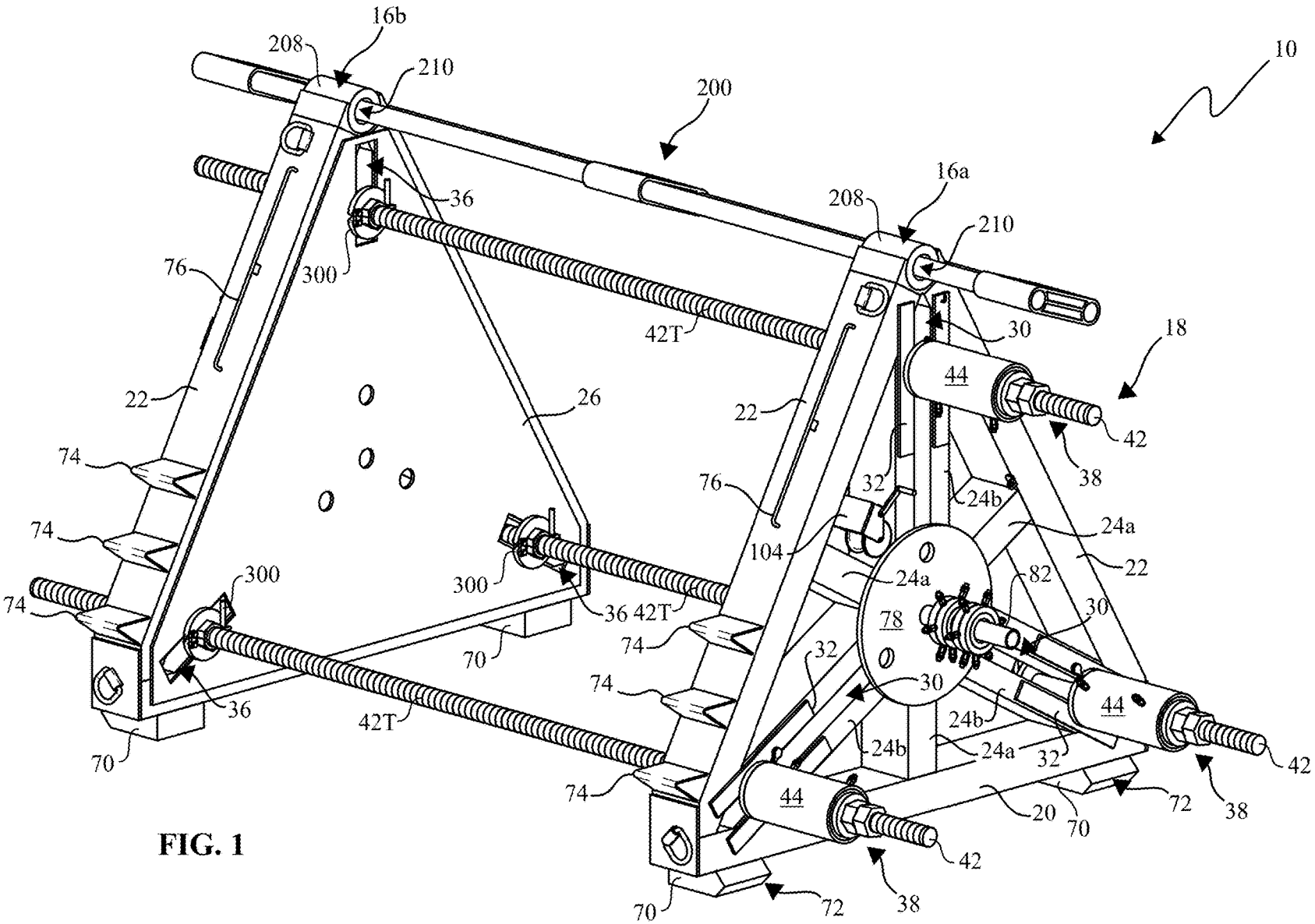
FIG. 1 is a perspective view of a telescoped coil compressing machine constructed in accordance with the principles of the present invention.

Corresponding reference characters indicate corresponding parts throughout several views. Although the exemplification set out herein illustrates certain embodiments of the invention, the embodiments disclosed below are not intended to be exhaustive or to be construed as limiting the scope of the invention to the precise form disclosed.

DETAILED DESCRIPTION OF THE PREFERRED EMBODIMENTS

Referring initially to FIGS. 1-6, a machine constructed in accordance with the principles of the present invention is shown and designated by the numeral 10. The machine 10 is configured to clamp and longitudinally compress a "telescoped" sheet material coil 12 for realigning the coil wraps 14 and thereby "untelescoping" the coil 12. More particularly, sheet and plate materials, such as, for example, metal sheet and metal plate materials including sheet steel, plate steel, sheet aluminum, sheet brass, sheet titanium, and other metal sheet and metal materials, paper sheet materials, plastic sheet materials, and other sheet material products, are commonly manufactured in long strips which are wound into cylindrical coils 12. The coils 12 comprise a plurality of overlapping wraps 14 which are wound into concentric spirals around a central longitudinal axis A1. (See FIGS. 3-6). When sheet materials, and in particular high-tensile strength sheet materials such as, for example, sheet steel and sheet aluminum, are wound into coils 12, the wraps 14 of the coil 12 are subjected to internal compressive and tensile/expansive forces (illustrated in FIGS. 4 and 6 by arrows FI) which resist the bending deformation of the sheet material. These internal forces FI cause the inner coil wraps 14 to drive radially outwardly against the adjacent surrounding wraps 14.

Figure 3:
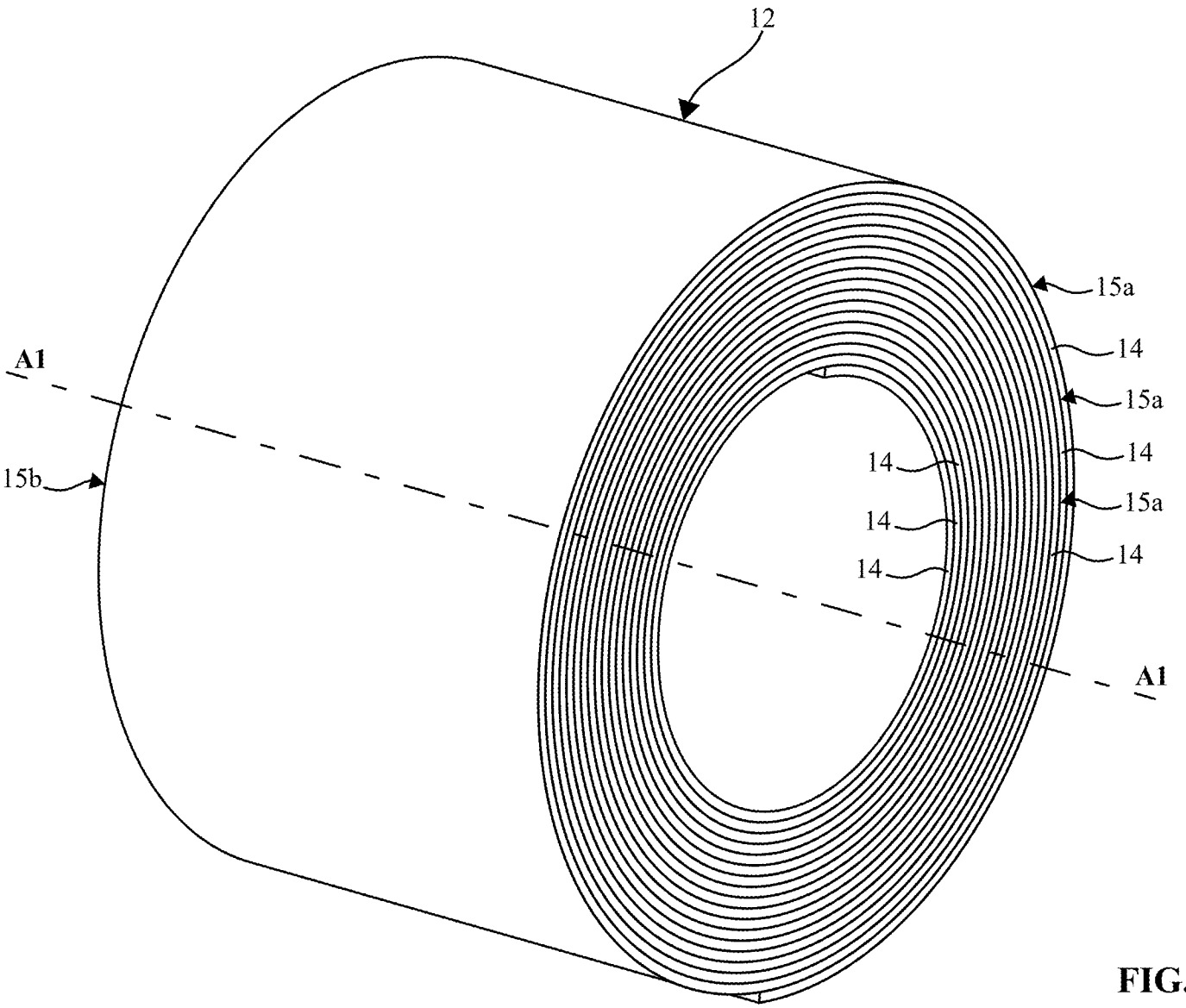
FIG. 3 is a perspective view of a coil of sheet material.
Figure 4:
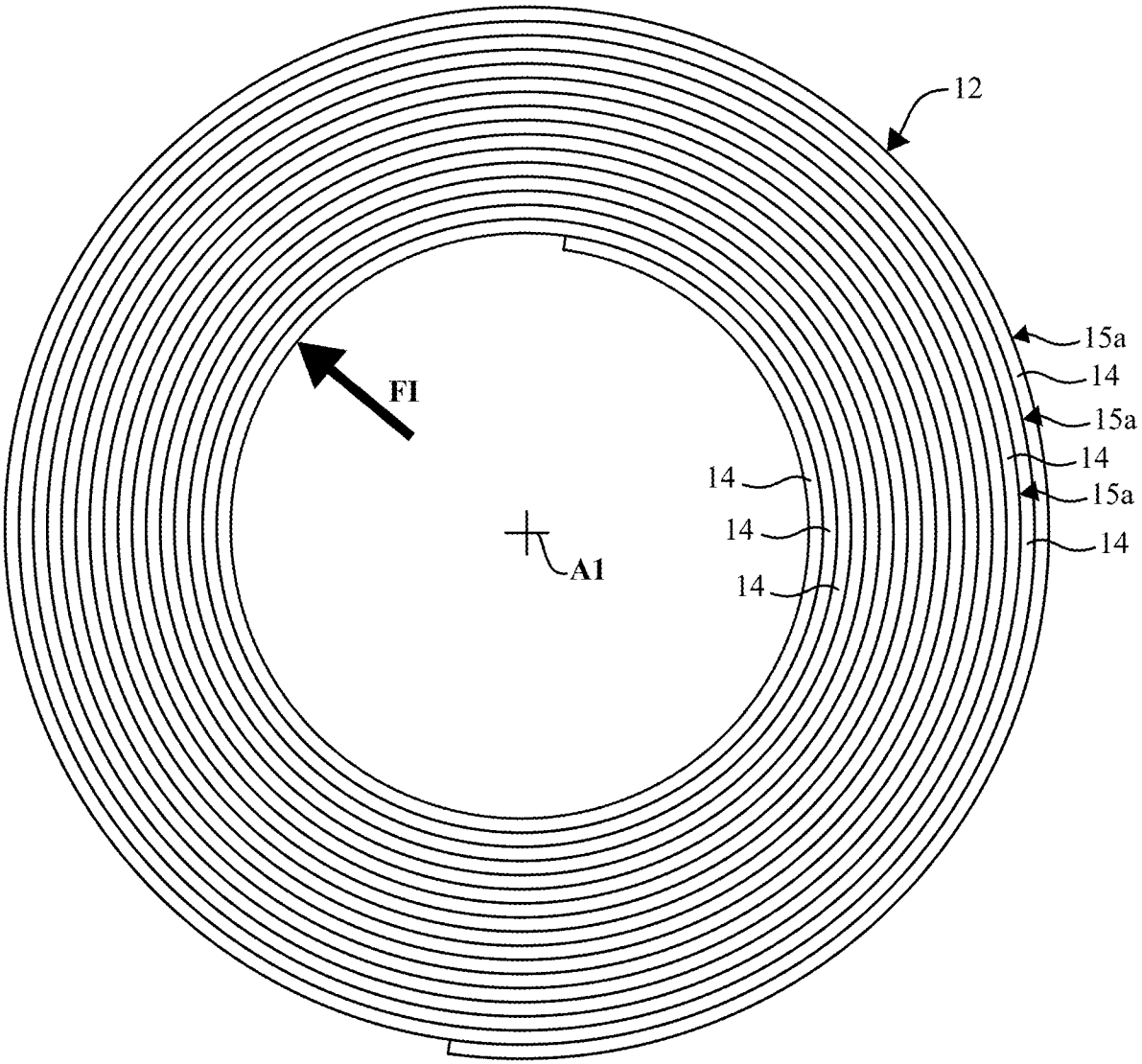
FIG. 4 is an end elevation view of the coil shown in FIG. 3.
Figure 5:
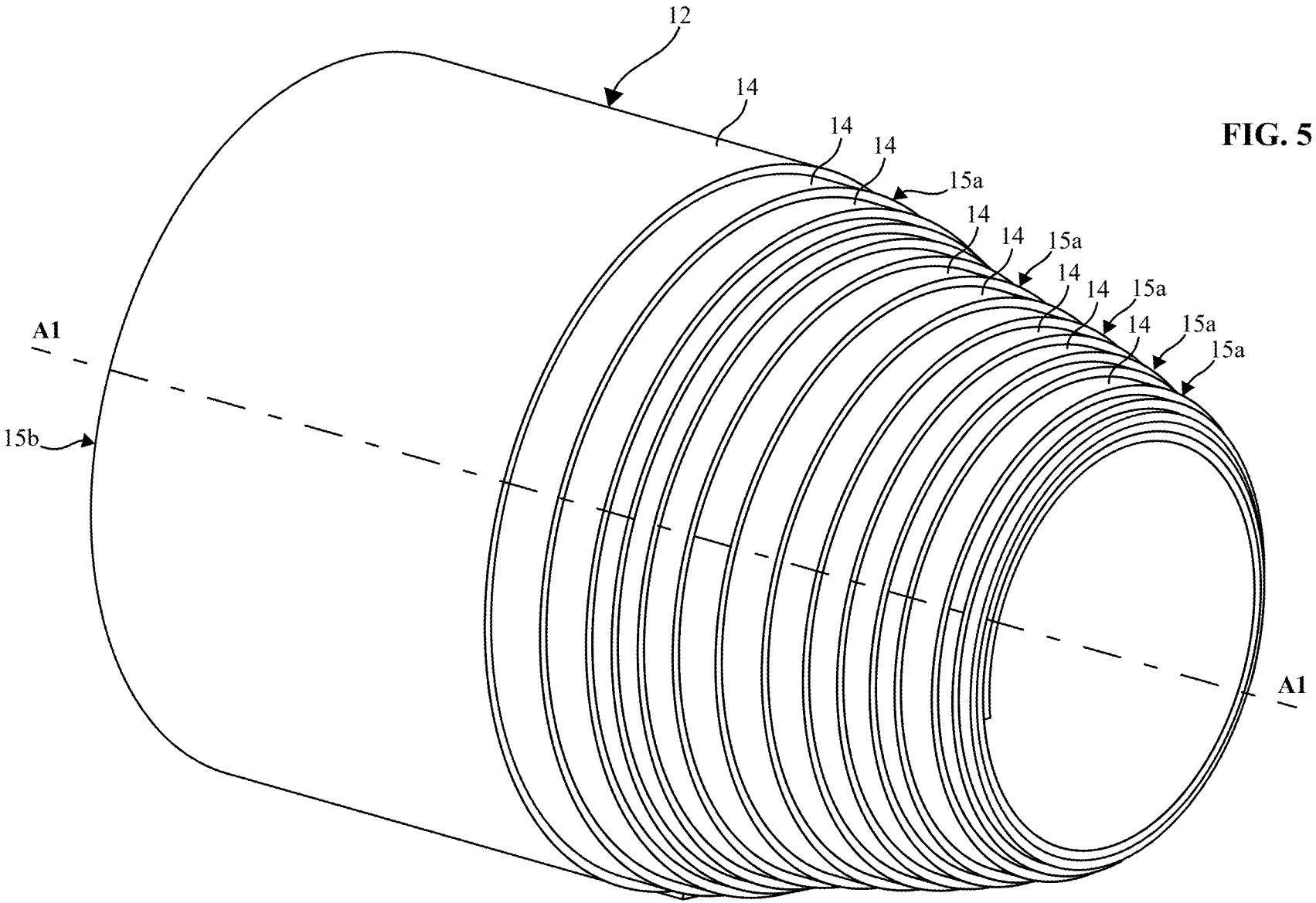
FIG. 5 is a perspective view of a telescoped coil.
Figure 6:
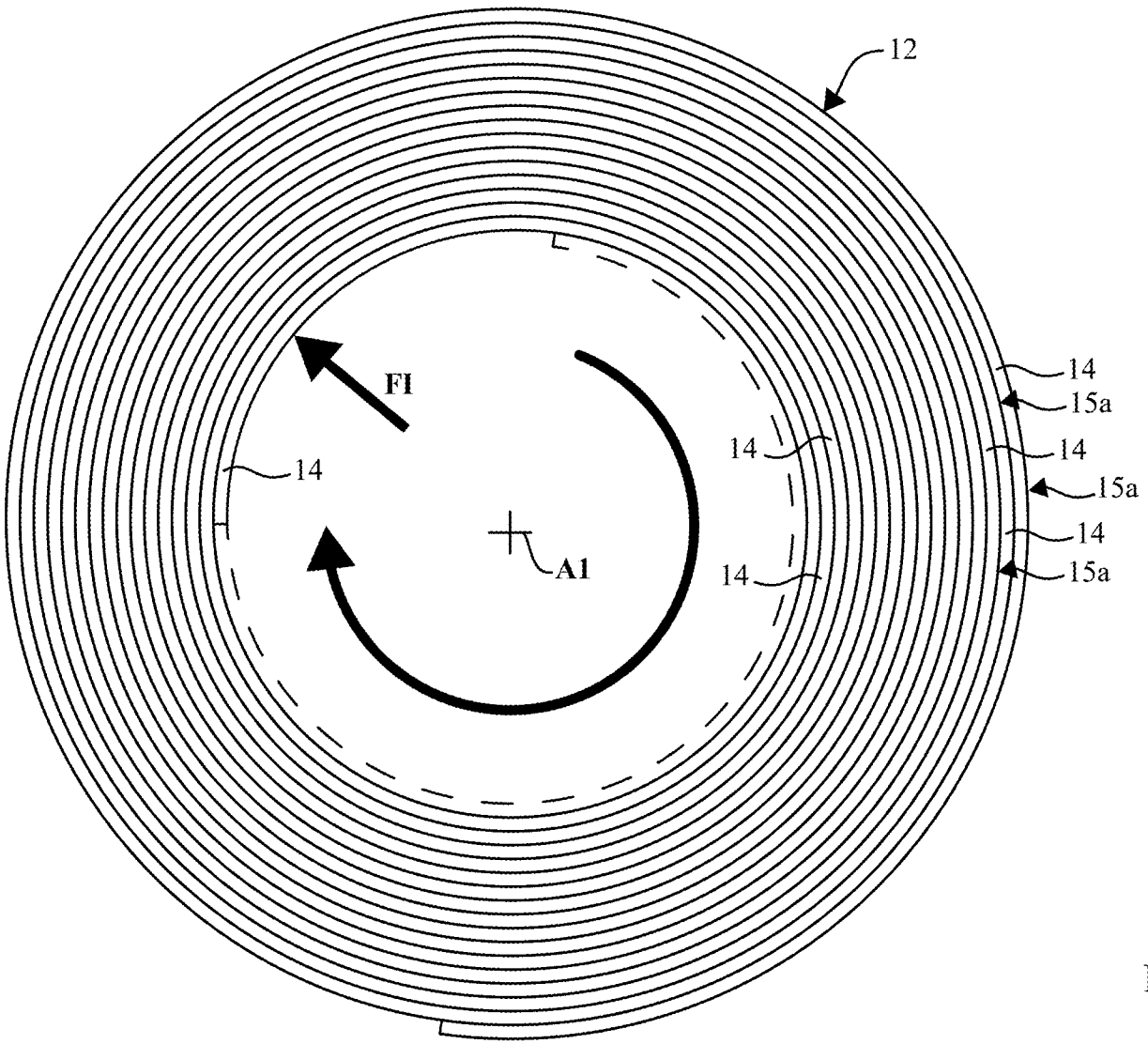
FIG. 6 is an end elevation view of the telescoped coil shown in FIG. 5.

Sheet materials are typically wound into coils 12 because it reduces the space necessary for storing such materials and also makes them easier to transport, handle, and use. However, manufacturing defects, such as, for example, oscillation occurring while winding the coil 12, or impact forces experienced during transportation or handling can cause the coil wraps 14 to slide or shift and become misaligned with each other. For example, as shown in FIGS. 5 and 6, oscillation and/or impact forces can cause the inner coil wraps 14 to shift and unravel whereby the coil 12 elongates in a direction along its central longitudinal axis A1. This type of misalignment is commonly referred to as "telescoping". When the coil wraps 14 unravel and telescope, the internal compressive and tensile/expansive forces FI cause the telescoped wraps 14 to unwind relative to the coil longitudinal axis A1. For example, as illustrated in FIGS. 3 and 4, the untelescoped coil 12 has wraps 14 which are wound in a clockwise direction around the coil longitudinal axis A1. As the inner wraps 14 of the coil 12 unravel and telescope, they unwind in a counterclockwise direction relative to the coil longitudinal axis A1 (illustrated by the counterclockwise arrow in FIG. 6).

Telescoped coils 12 are significantly more difficult to transport, handle, and use. Accordingly, the machine 10 is configured to longitudinally compress the telescoped coil 12 for realigning the wraps 14. Additionally, when the unwound/telescoped coil wraps 14 are longitudinally compressed, the machine 10 is configured to twist for allowing the telescoped coil wraps 14 to slide and coil radially inwardly whereby the coil wraps 14 rewind as they are longitudinally compressed.

As shown in FIGS. 1, 2, and 7-11, the machine 10 comprises a pair of side walls 16*a*, 16*b* and a drive system 18. The side walls 16*a*, 16*b* form the sides of the machine 10 and are spaced apart from each other for receiving a telescoped coil 12 therebetween. The drive system 18 includes one or more actuator assemblies 38 comprising frame coupler rods 42, linear actuators 44 (which are preferably hydraulic cylinders), and adjustable stop pieces 46. The actuator assemblies 38 couple the side walls 16*a*, 16*b* together and are adapted to selectively drive the side walls 16*a*, 16*b* towards and clamp the side walls 16*a*, 16*b* against the sides of the telescoped coil 12 for thereby longitudinally compressing and "untelescoping" the telescoped coil 12.

Figure 12:
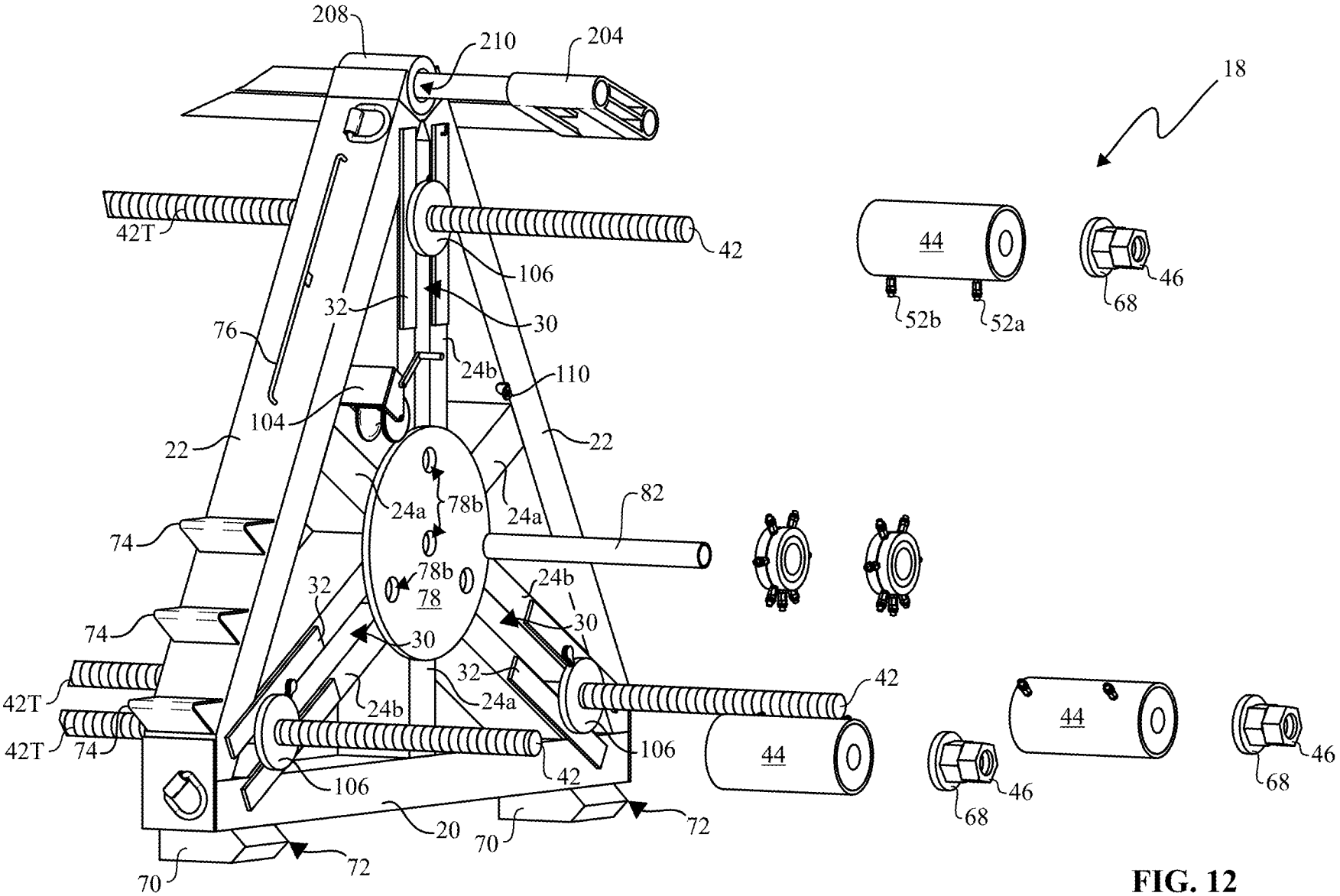
FIG. 12 is a partially exploded perspective view showing the linear actuators, adjustable end pieces, and hydraulic manifolds exploded apart from the frame coupler rods.

In the present exemplary embodiment, the side walls 16*a*, 16*b* are A-frame structures comprising a horizontal beam 20, a pair of legs 22, a plurality of spokes 24*a*, 24*b*, and a face plate 26. The horizontal beam 20 forms the bottom of the side wall 16 and preferably includes a pair of box-shaped feet 70 that are mounted to the bottom of the horizontal beam 20 and support the side wall 16 above the ground. As best seen in FIG. 12, the feet 70 include wedge-shaped leading ends 72. In use, the wedge-shaped leading ends 72 allow the feet 70, and, hence, the side walls 16*a*, 16*b*, to be slidingly dragged along the ground for adjusting the distance between the side walls 16*a*, 16*b*.

The legs 22 extend upwardly one from each end of the beam 20 and are secured together at the upper end of the side wall 16. Preferably, one or more of the legs 22 includes steps 74 and a handle 76 secured thereto. The steps 74 and handle 76 allow the machine operator to climb up the leg 22 to access a crane/lift engaging coupler assembly 200 which is slidably mounted between the upper ends of the side walls 16*a*, 16*b*.

Figure 8:
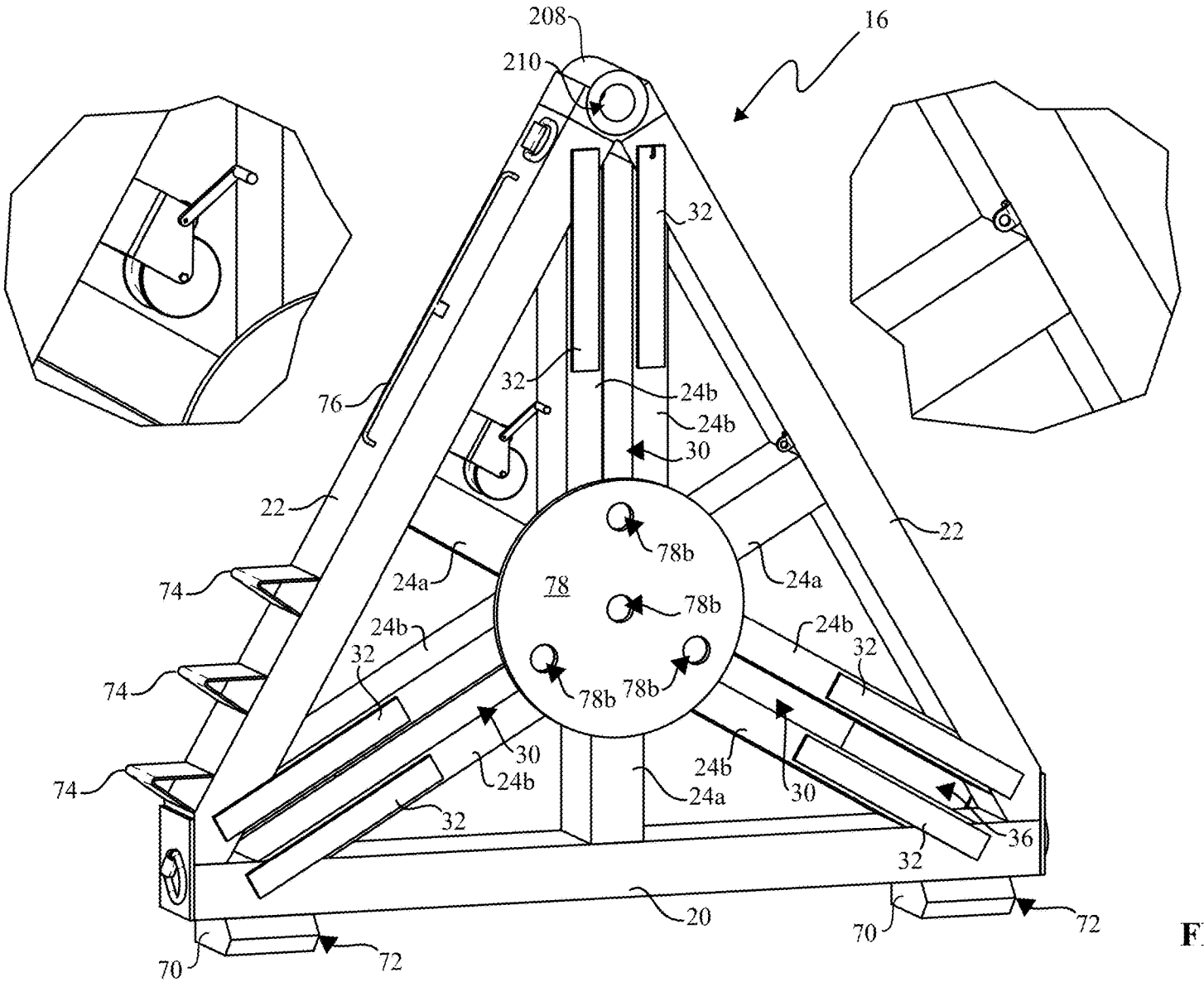
FIG. 8 is a perspective view of a side wall shown in FIG. 7.
Figure 9:
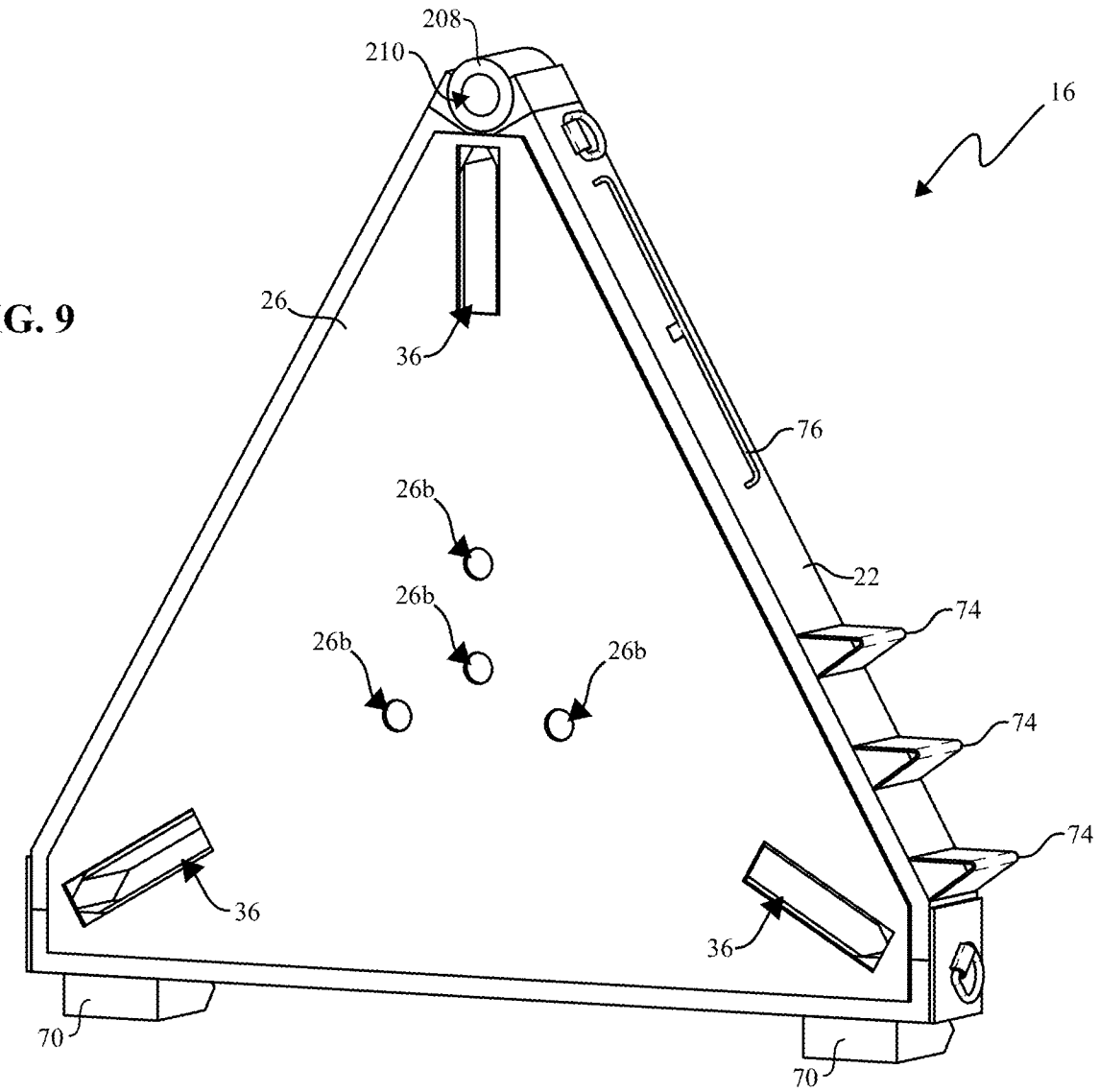
FIG. 9 is another perspective view of the side wall.
Figure 10:
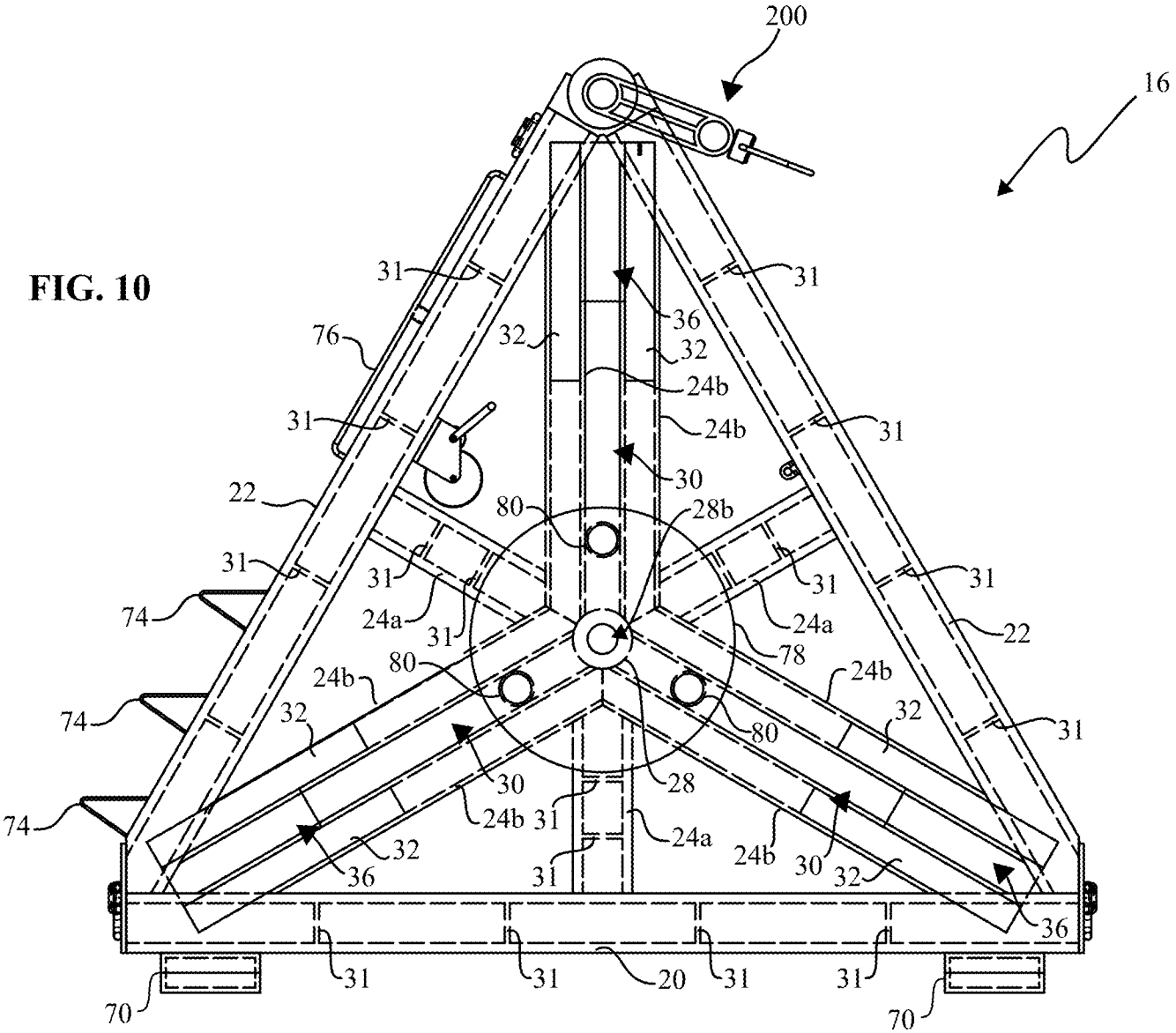
FIG. 10 is a side elevation view of the side wall wherein the internal ribs, central hub tube, and mounting tubes are shown in dashed lines.
Figure 11:
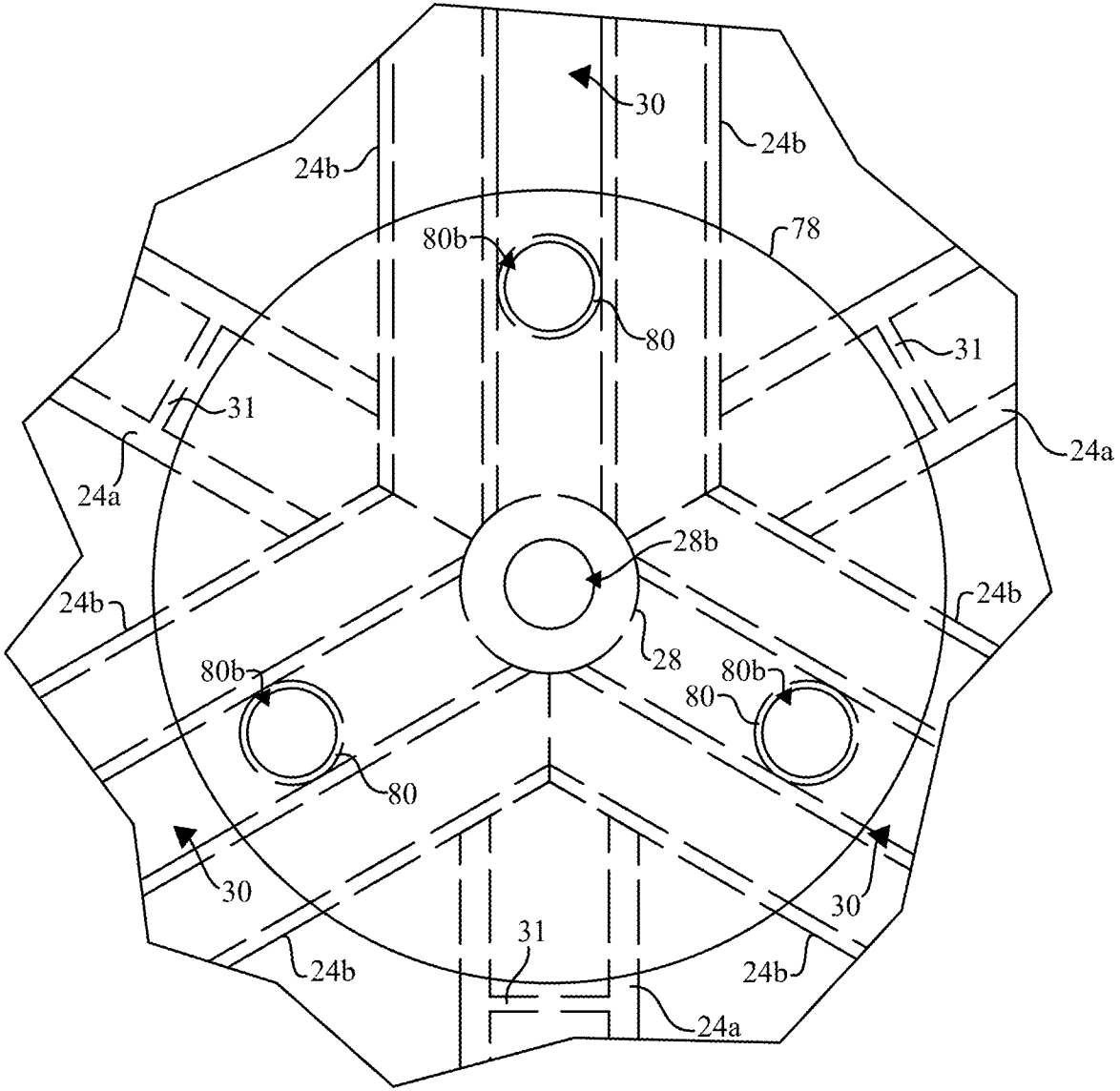
FIG. 11 is a magnified view of Circled Detail 11 in FIG. 10 showing the actuator mounting plate, central hub tube, and spokes.

As best seen in FIGS. 8, 10, and 11, the spokes 24*a*, 24*b* extend outwardly from a central hub tube 28 and are secured to the beam 20/legs 22. The hub tube 28 is supported near the center of the side wall 16 between the beam 20 and the legs 22 and includes a hub tube bore 28*b*. The spokes 24*a* extend from the hub tube 28 generally perpendicular to and are secured one to each of the beam 20 and the legs 22. The spokes 24*b* are provided in pairs with each pair extending towards one of the corners formed between the beams 20 and the legs 22. The spokes 24*b* of each pair extend generally parallel to each other and are spaced apart whereby coupler rod receiving frame slots 30 are defined therebetween.

The horizontal beam 20, legs 22, and spokes 24*a*, 24*b* are preferably constructed from rectangular steel tubing stock which is cut to length and secured together by securing means such as, for example, welding, fastening, or sintering. Additionally, the horizontal beam 20, legs 22, and spokes 24*a* preferably include internal ribs 31. The internal ribs 31 are preferably provided at regular intervals along the lengths of the horizontal beam 20, legs 22, and spokes 24*a* and are configured to reinforce and increase the rigidity of the horizontal beam 20, legs 22, and spokes 24*a* for thereby supporting and reinforcing the face plates 26 which are mounted abutting against the horizontal beam 20, legs 22, and spokes 24*a*, 24*b*.

Preferably, piston abutment plates 32 constructed from a high-strength, abrasion resistant material, such as, for example, AR 400 abrasion resistant steel and other abrasion resistant steel materials, are secured to the spokes 24*b* one on either side of the frame slots 30. In use, the piston abutment plates 32 protect and reduce wear and tear on the spokes 24*b* for thereby increasing the service life of the spokes 24*b*/side walls 16*a*, 16*b*. Yet more preferably, the piston abutment plates 32 are constructed from a surface hardened, high-strength, abrasion resistant material, such as, for example, a surface hardened AR 400 abrasion resistant steel and other surface hardened abrasion resistant steel materials. Using surface hardened abrasion resistant materials allows the piston abutment plates 32 to withstand the friction with the hydraulic cylinder pistons 50 while also allowing the piston abutment plates 32 to bend and flex slightly to absorb impacts and other forces experienced during operation of the machine 10.

The face plates 26 are mounted on the interior sides of the side walls 16*a*, 16*b* and include planar coil engaging surfaces 34 and window openings 36. The planar coil engaging surfaces 34 form the interior side surfaces of the side walls 16*a*, 16*b* and are configured to engage and abut against the terminal end side edges 15*a*, 15*b* of the coil wraps 14. The window openings 36 extend through the coil engaging surfaces 34 adjacent to the corners of the face plates 26 and are configured to align and extend along the frame slots 30.

Figure 20:
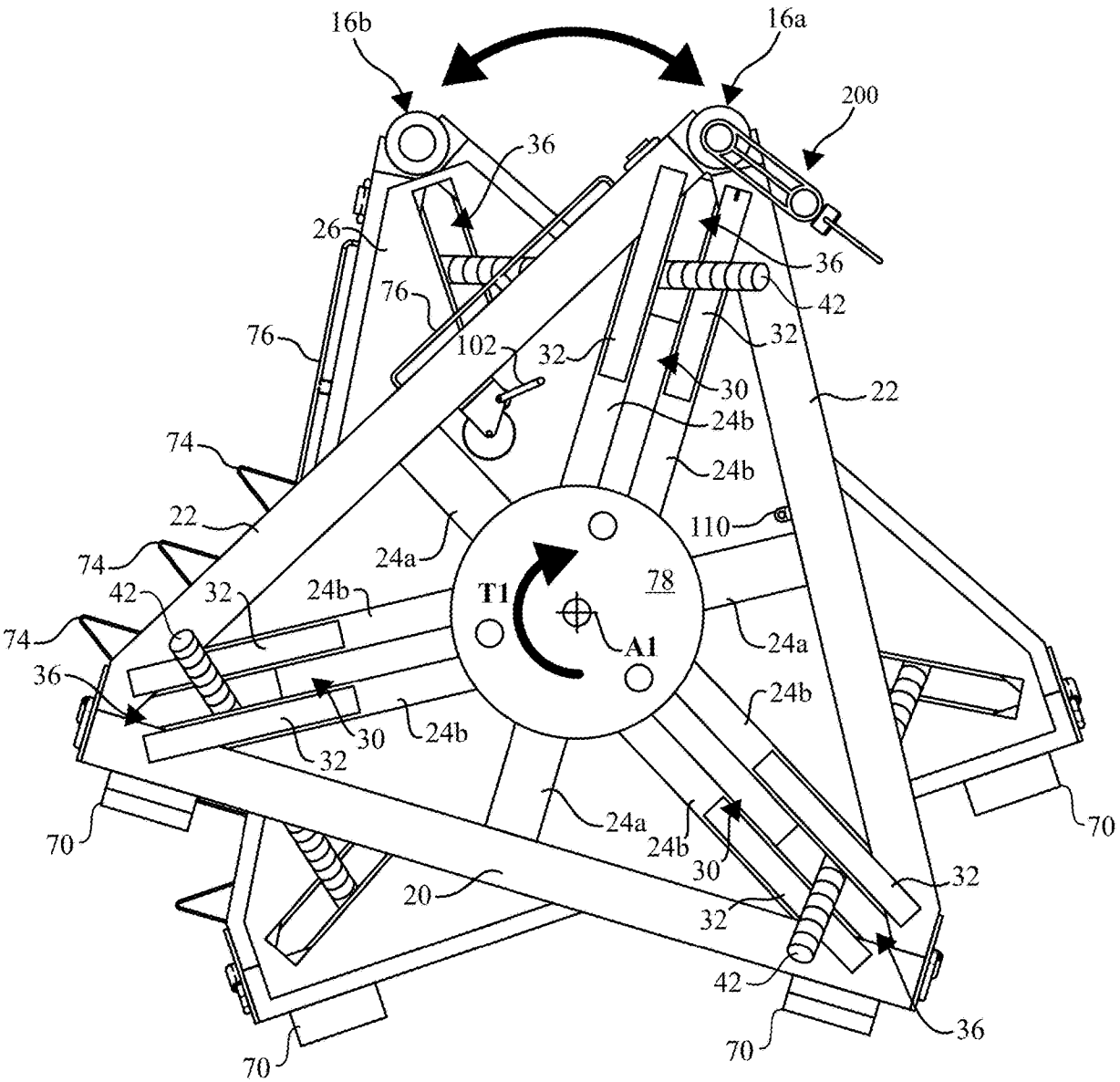
FIG. 20 is a side elevation view of the machine shown in FIGS. 18 and 19 wherein the side walls have twisted relative to each other and have rotated together with the telescoped coil wraps.
Figure 21:
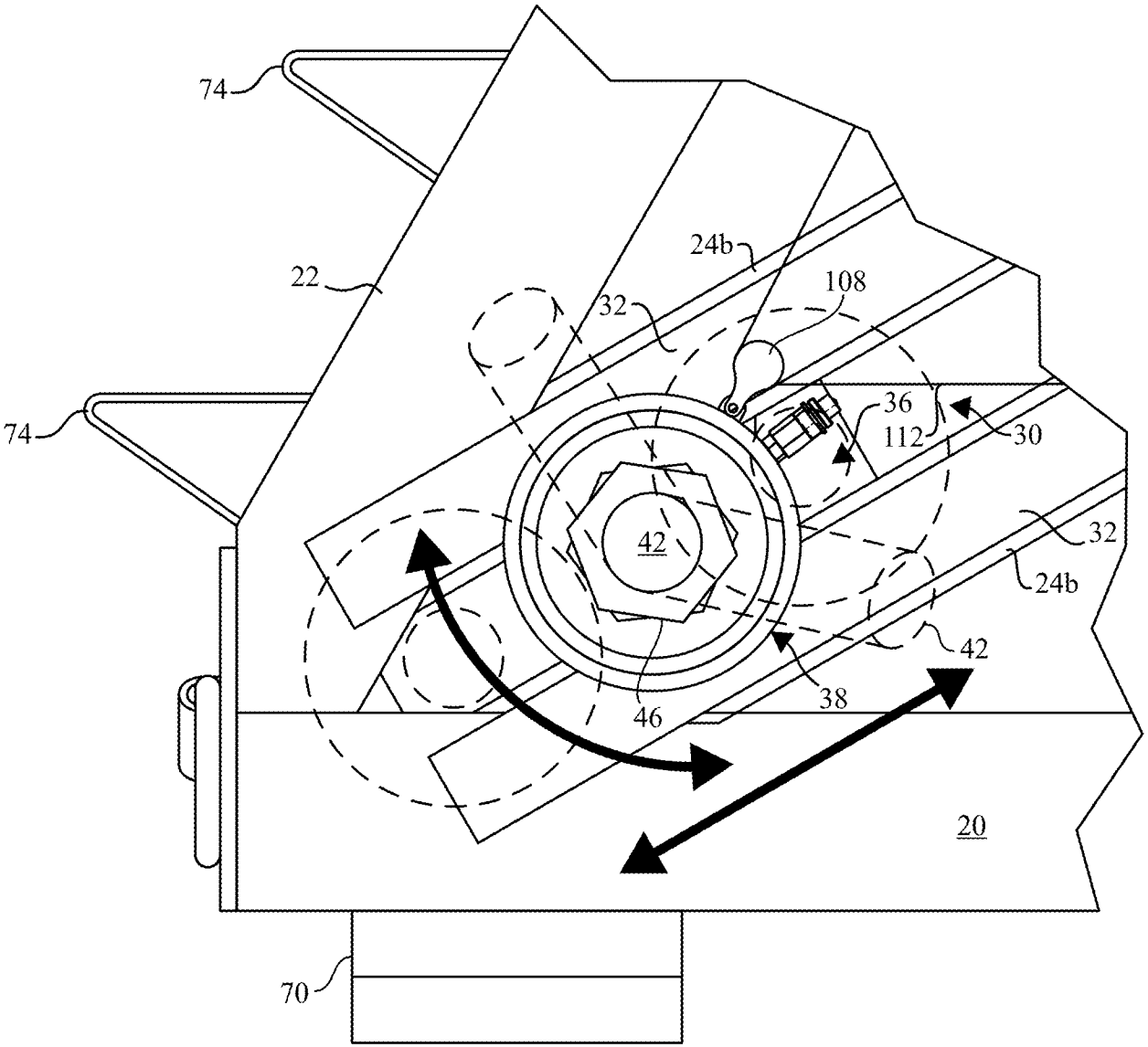
FIG. 21 is a magnified detail view of Circled Detail 21 in FIG. 13 showing the pivoting and sliding of the frame coupler rods within the window openings/frame slots.

In use, the frame coupler rods 42 of the drive system actuator assemblies 38 are configured to be loosely received through the window openings 36/frame slots 30 whereby the frame coupler rods 42 are pivotably and slidingly movable within the window openings 36/frame slots 30. Configuring the frame coupler rods 42 to be loosely received through the window openings 36/frame slots 30 allows the side walls 16*a*, 16*b* to move independently and twist and rotate relative to each other, for example, as shown in FIGS. 20 and 21.

Preferably, the face plates 26 are also formed from a high-strength, abrasion resistant material, such as, for example, AR 400 abrasion resistant steel and other abrasion resistant steel materials, such that the face plates 26 better withstand the friction between the coil engaging surfaces 34 and the coil wrap terminal end side edges 15*a*, 15*b*. Yet more preferably, the face plates 26 are constructed from a surface hardened, high-strength, abrasion resistant material, such as, for example, a surface hardened AR 400 abrasion resistant steel and other surface hardened abrasion resistant steel materials. Using surface hardened abrasion resistant materials allows the face plates 26 to withstand the friction with the side edges 15*a*, 15*b* while also allowing the face plates 26 to bend and flex slightly to absorb impacts and other forces experienced during operation of the machine 10.

Figure 7:
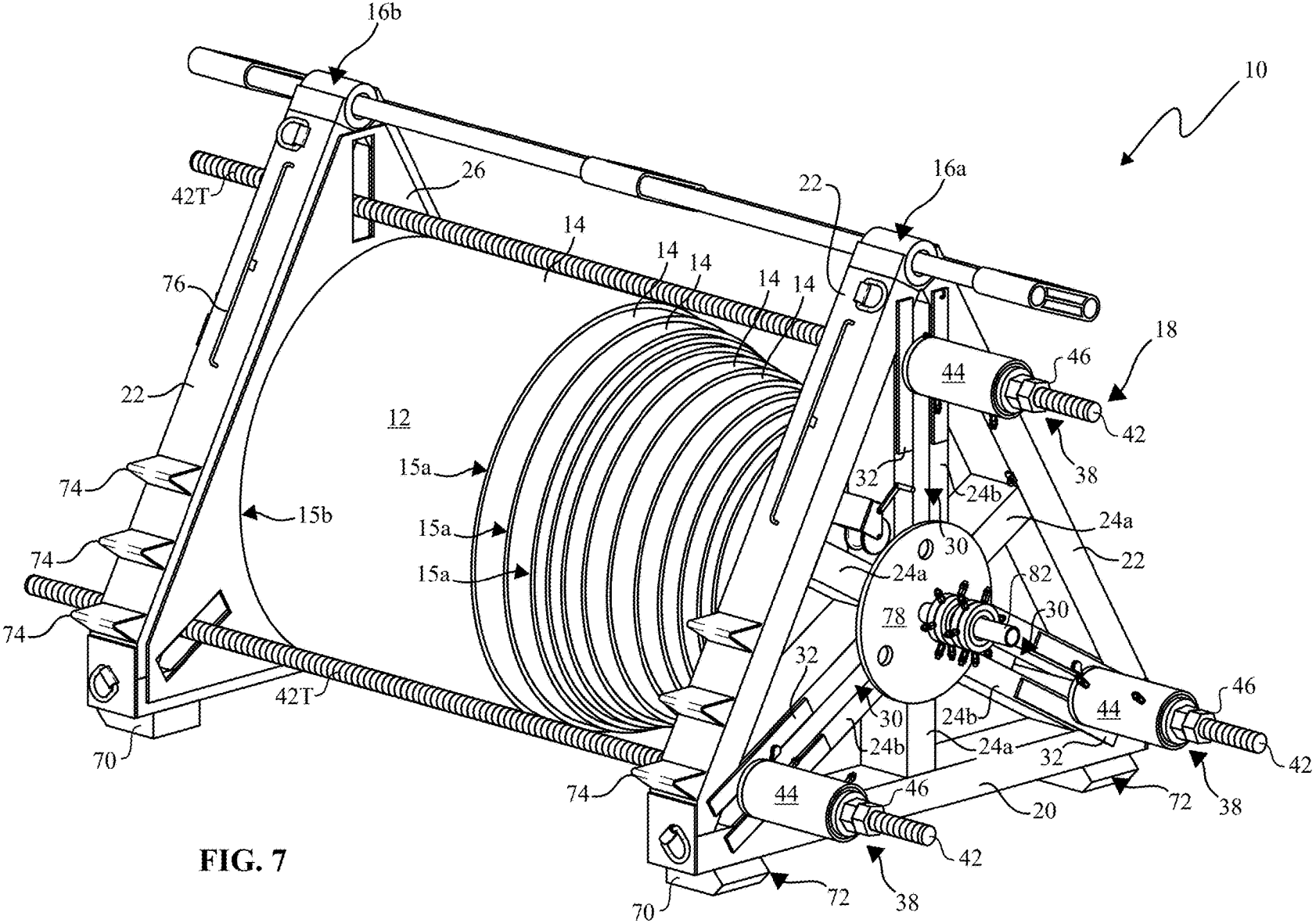
FIG. 7 is a perspective view of the machine shown in FIG. 1 with a telescoped coil received between the side walls of the machine.
Figure 23:
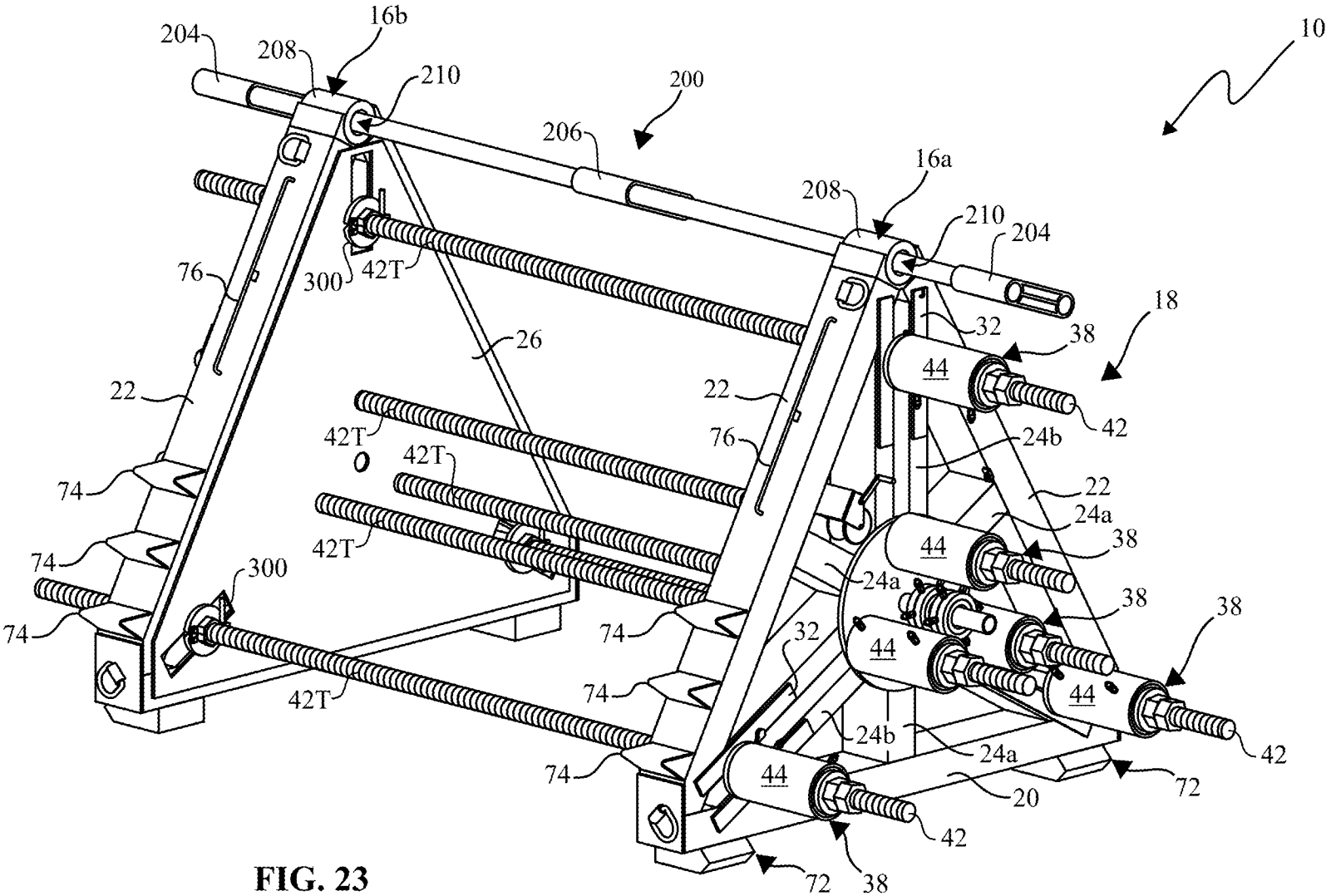
FIG. 23 is a perspective view of a machine having additional actuator assemblies mounted to the actuator mounting plate and actuator mounting tubes.
Figure 24:
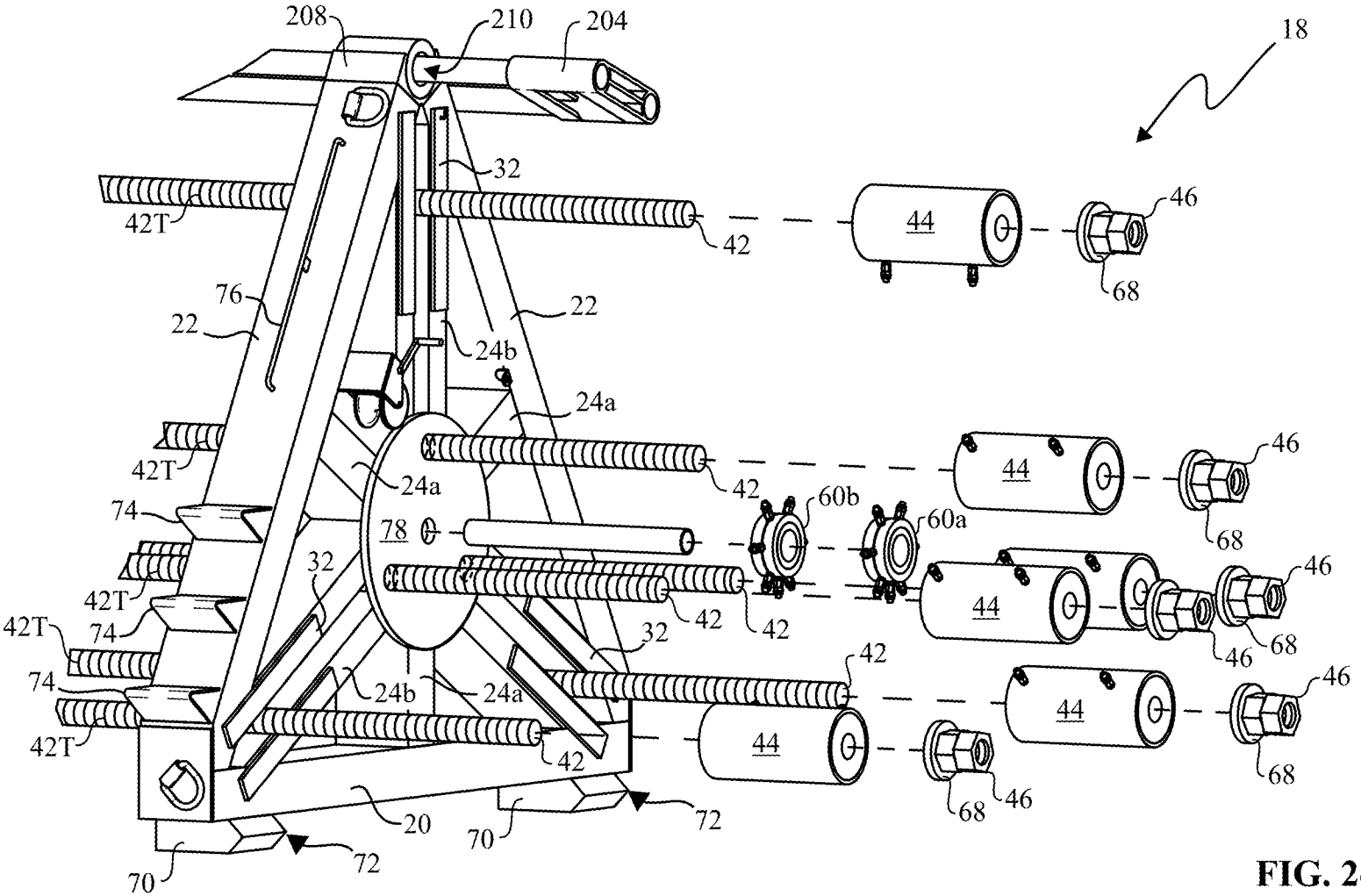
FIG. 24 is a partially exploded perspective view of the machine shown in FIG. 23 wherein the linear actuators, adjustable end pieces, and hydraulic manifolds have been exploded apart from the frame coupler rods.
Figure 25:
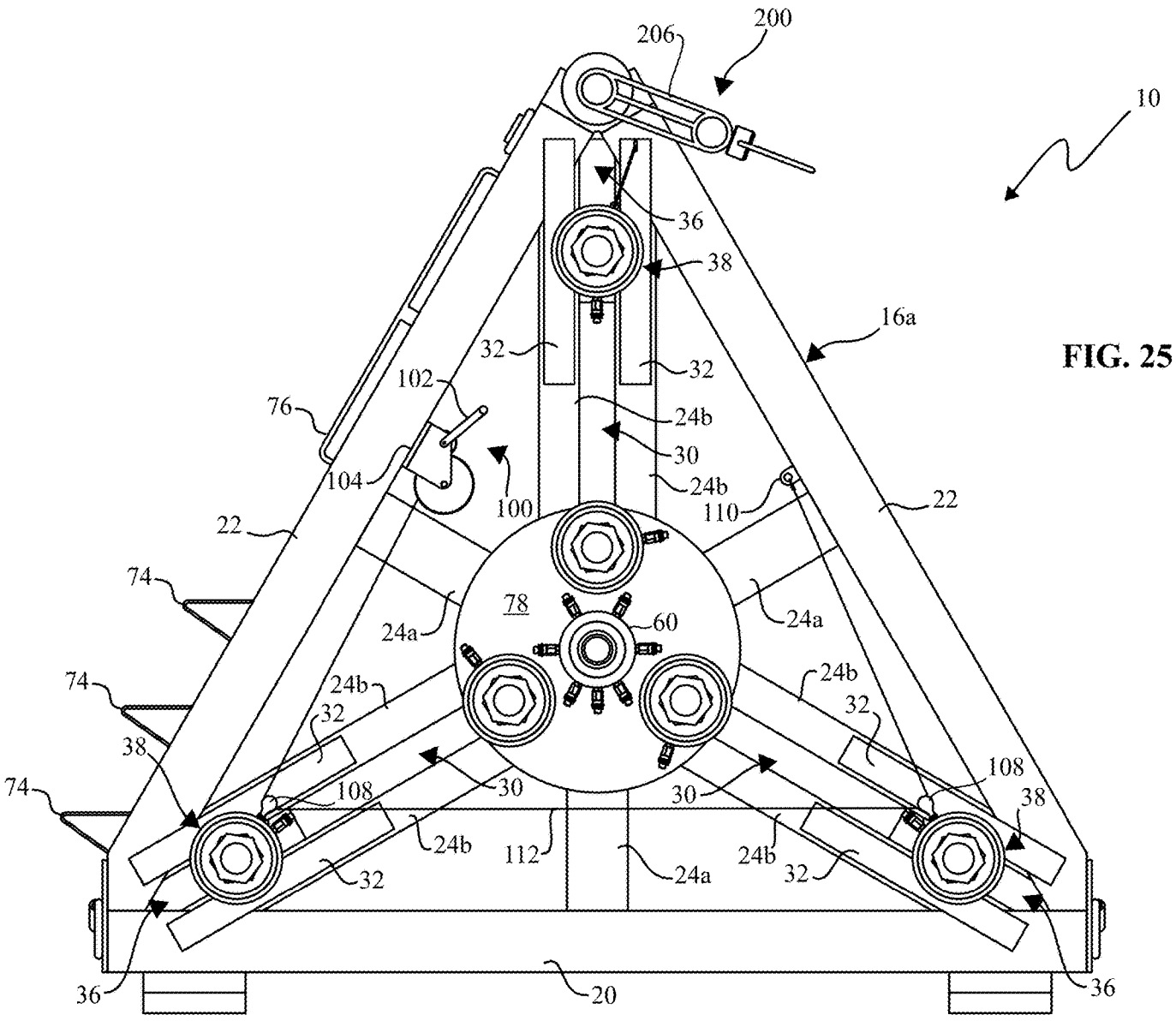
FIG. 25 is a side elevation view of the machine shown in FIG. 23.

Each side wall 16*a*, 16*b* also includes an actuator mounting plate 78 and actuator mounting tubes 80. As best seen in FIGS. 7, 8, and 12, the actuator mounting plates 78 are mounted to the spokes 24*a*, 24*b* on the exterior sides of the side walls 16*a*, 16*b* opposite the face plates 26 and include actuator mounting plate bores 78*b* which are configured to align with the frame slots 30 and the hub tube 28. The face plates 26 preferably also include a plurality of face plate bores 26*b* which are configured to align with the actuator mounting plate bores 78*b*. The actuator mounting tubes 80 are mounted between the face plates 26 and the actuator mounting plates 78 and include mounting tube bores 80*b* which are configured to align with the actuator mounting plate bores 78*b* and the face plate bores 26*b*. In use, additional actuator assemblies 38 can be mounted to the side walls 16*a*, 16*b* by slidingly receiving and extending frame coupler rods 42 through the actuator mounting plate bores 78*b*, the mounting tube bores 80*b*, and the face plate bores 26*b*, for example, as shown in FIGS. 23-25. These additional actuator assemblies 38 can be used to increase the clamping forces F1, F2 applied to the coil wraps 14 by the machine 10.

Figure 13:
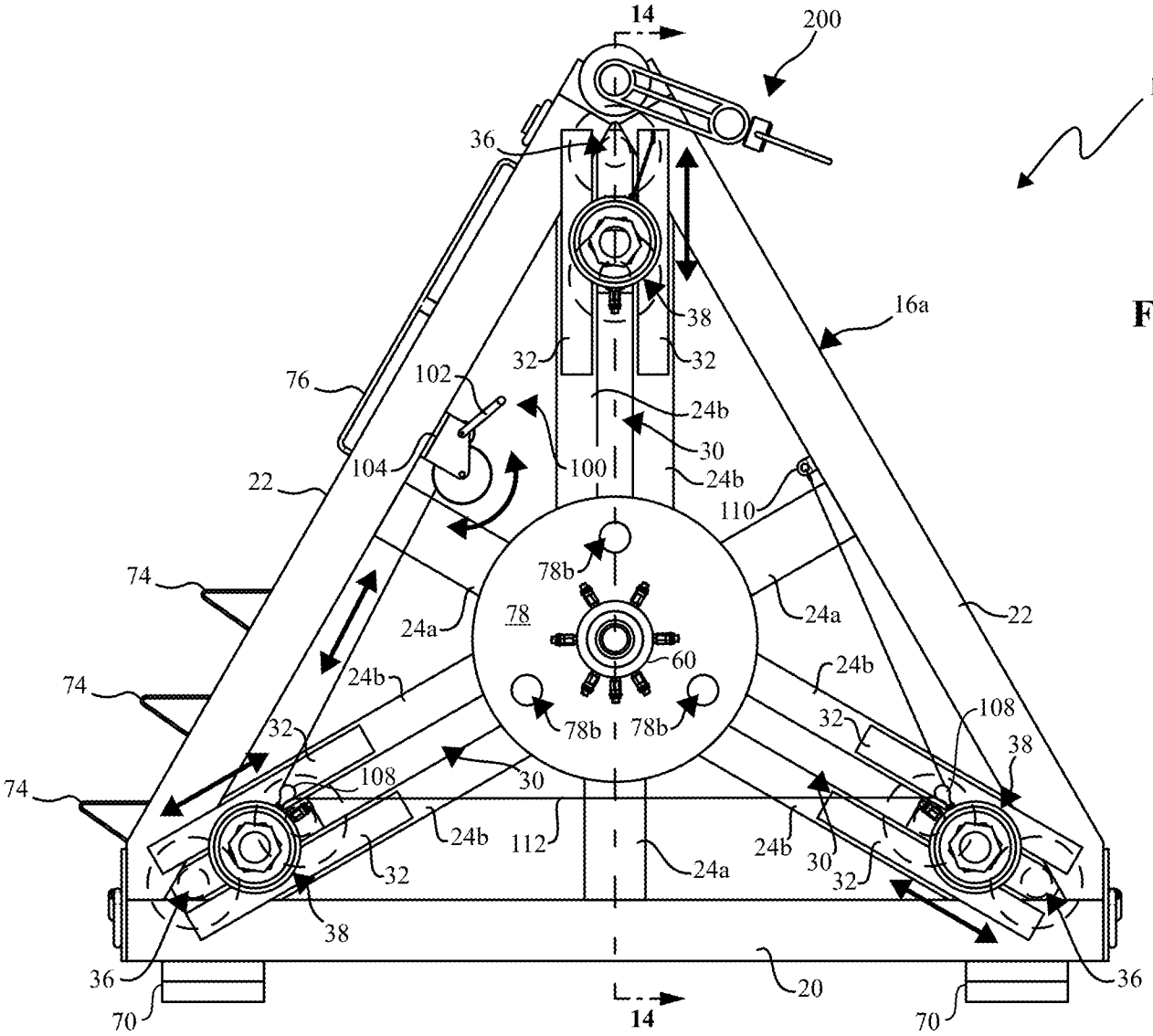
FIG. 13 is a side elevation view of the machine shown in FIG. 7.
Figure 22:
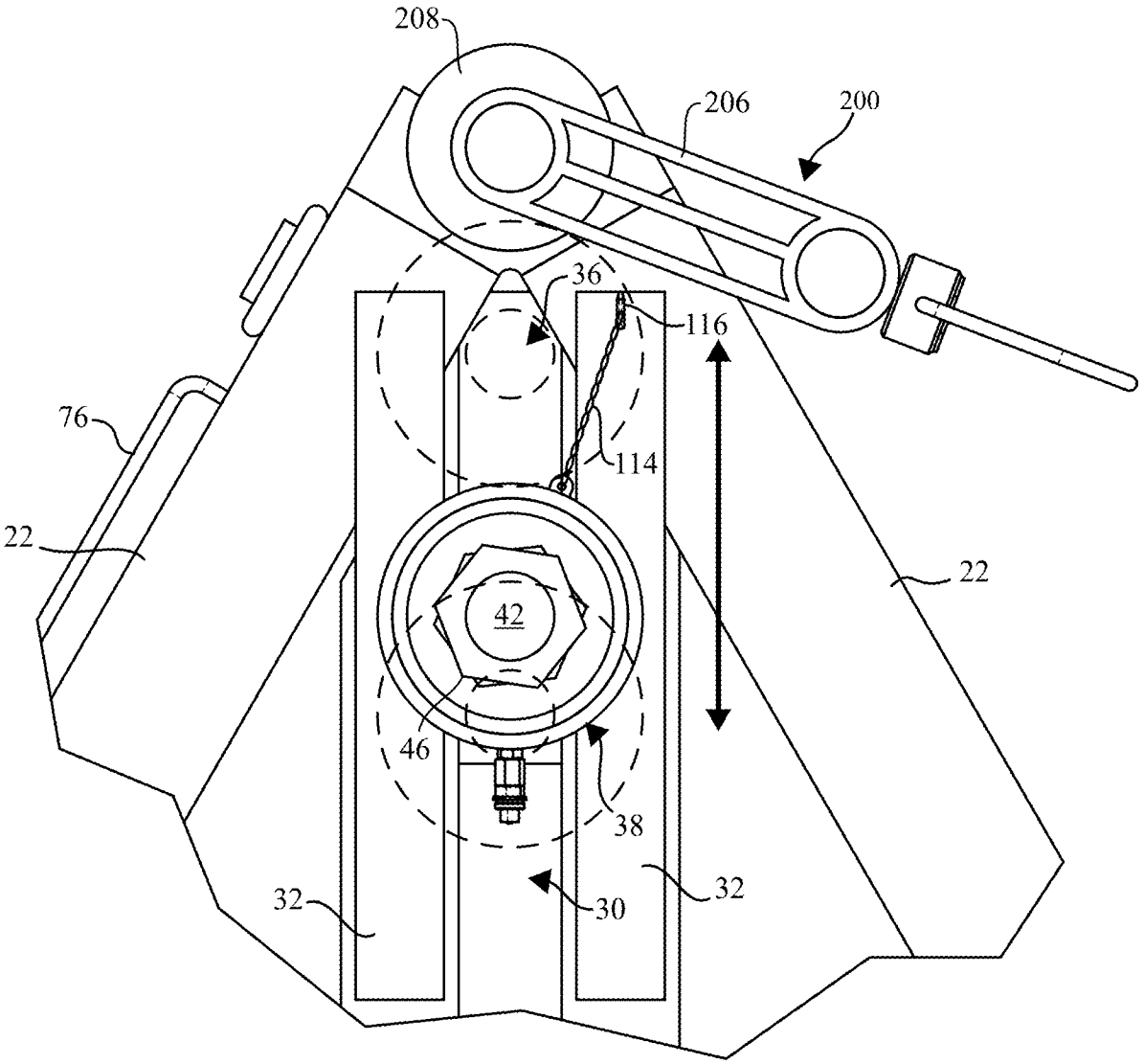
FIG. 22 is a magnified detail view of Circled Detail 22 in FIG. 13 showing the adjustment of the actuator assembly mounted at the upper end of the machine/side walls.

Preferably, each side wall 16*a*, 16*b* includes an actuator assembly position adjustment system 100 adapted for selectively adjusting the position of the drive system actuator assemblies 38 relative to said side wall 16*a*, 16*b*. As best seen in FIGS. 8, 13, 21, and 22, the position adjustment system 100 can comprises, for example: a winch 102 which is mounted to one of the side wall legs 22 by a bracket 104; coupler plates 106 having pulleys 108 secured thereto, wherein the coupler plates 106 are mounted on the frame coupler rods 42 and sandwiched between the piston abutment plates 32 and the hydraulic cylinders 44; an anchor member 110 which is mounted to the leg 22 opposite the winch 102; and a cable 112 which is wrapped around the winch 102 at one end, loops through the coupler plate pulleys 108 and is secured to the anchor member 110 at the other end. As illustrated in FIGS. 13 and 21, the winch 102 can be used to selectively tighten and retract the cable 112 for slidingly pulling the actuator assemblies 38 up and inwardly towards the center of the side wall 16 along the window openings 36/frame slots 30 or to selectively loosen and extend the cable whereby gravity causes the actuator assemblies 38 to slide down and outwardly away from the center of the side wall 16 along the window openings 36/frame slots 30. Additionally, as best seen in FIG. 22, the actuator assembly 38 mounted adjacent to the upper end of the machine 10 can be hung from the side walls 16*a*, 16*b* via chains 114 and hooks 116.

Turning to FIGS. 12-17, the drive system 18 includes at least one, and preferably three or more, actuator assemblies 38 which are powered by a power source 40. The actuator assemblies 38 are coupled to the side walls 16*a*, 16*b* and comprise frame coupler rods 42, linear actuators 44, and adjustable stop pieces 46. The frame coupler rods 42 are preferably cylindrical, threaded rods which are adapted to extend between the side walls 16*a*, 16*b* and are received through the window openings 36/frame slots 30 or through the actuator mounting plate bores 78*b*, actuator mounting tube bores 80*b*, and face plate bores 26*b*.

Figure 15:
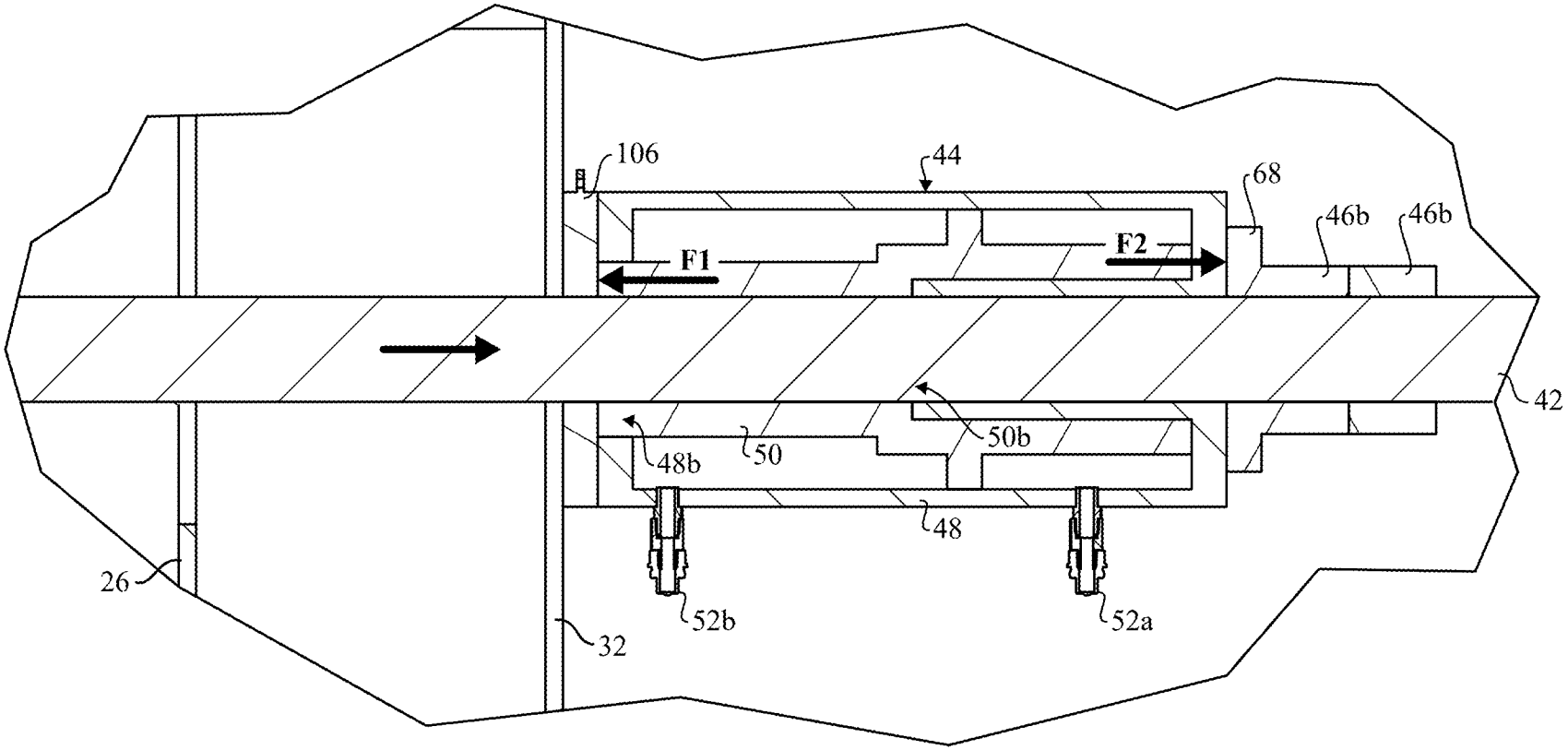
FIG. 15 is a magnified detail view of Circled Detail 15 in FIG. 14 showing the hydraulic cylinder, frame coupler rod, and adjustable end piece.

The linear actuators 44 can be, for example, hydraulic actuators, pneumatic actuators, electric actuators, mechanical actuators, or other types of linear actuators. In the present exemplary embodiment, the linear actuators 44 are preferably commercially available hollow, double-acting hydraulic cylinders. As best seen in FIG. 15, the hollow, double acting hydraulic cylinders 44 comprise a housing 48 and a hollow piston 50 slidably mounted within the housing 48. The housing 48 and the piston 50 include respective housing and piston bores 48*b*, 50*b* which extend longitudinally through the housing 48 and piston 50 along the central longitudinal axis A1 of the cylinder 44. The housing and piston bores 48*b*, 50*b* are configured to receive a frame coupler rod 42 therethrough for slidably mounting the hydraulic cylinders 44 on the frame coupler rods 42. In use, the hydraulic cylinders 44 are preferably mounted with the pistons 50 engaging and abutting against the piston abutment plates 32 of a side wall 16.

The hydraulic cylinder 44 also includes a pair of hydraulic conduit couplings 52*a*, 52*b*. The hydraulic conduit couplings 52*a*, 52*b* are mounted to the housing 48 and are adapted to couple with hydraulic conduits 54*a*, 54*b* for thereby fluidly connecting the hydraulic cylinder 44 to a hydraulic power source 40 such as, for example, a hydraulic pump, and a hydraulic fluid reservoir 56. (See FIG. 16).

As mentioned above, the hydraulic cylinders 44 are preferably "double acting" whereby the hydraulic cylinders 44 are preferably configured to drive or pull the pistons 50 along the cylinders'longitudinal axis A1 when hydraulic fluid/pressure is provided to one of the hydraulic conduit couplings 52*a*, 52*b*. For example, as diagrammatically depicted in FIG. 16, when hydraulic fluid is pumped through, and hydraulic pressure is provided to, the first hydraulic conduit coupling 52*a*, the hydraulic cylinders 44 are adapted to extend and drive the pistons 50 towards the piston abutment plates 32/side wall 16. Similarly, when hydraulic fluid is pumped through, and hydraulic pressure is provided to, the second hydraulic conduit coupling 52*b*, the hydraulic cylinders 44 are adapted to pull the piston 50 away from the piston abutment plates 32/side wall 16.

Figure 16:
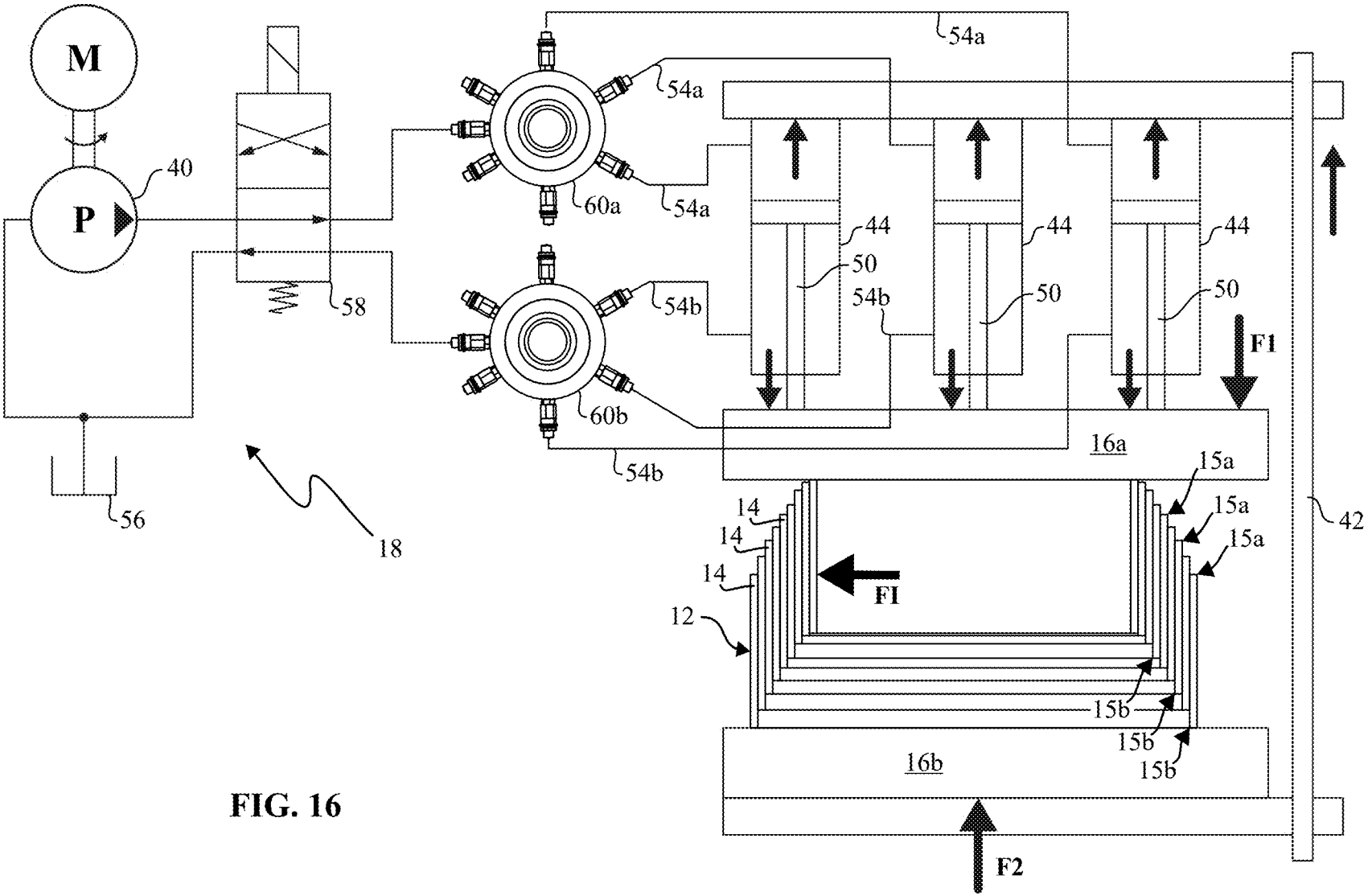
FIG. 16 is a block diagram of the drive system.
Figure 17C:
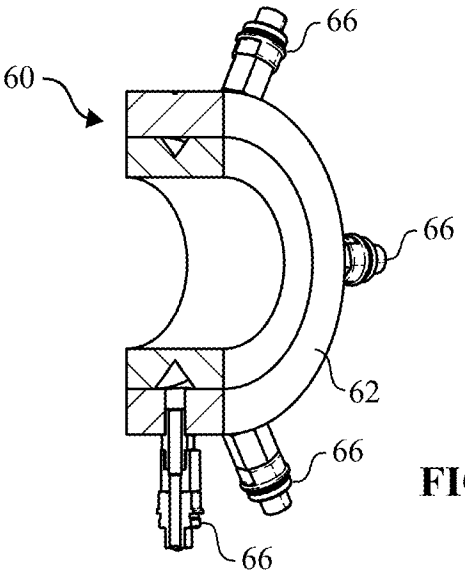
FIGS. 17A-D are a perspective view, side elevation view, cross section view, and magnified detail view of the hydraulic manifold shown in FIG. 16.
Figure 17D:
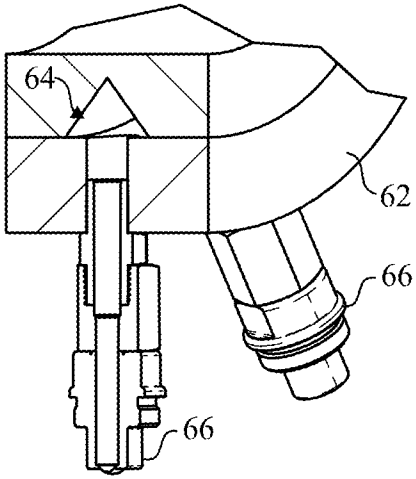
Figure 17A:
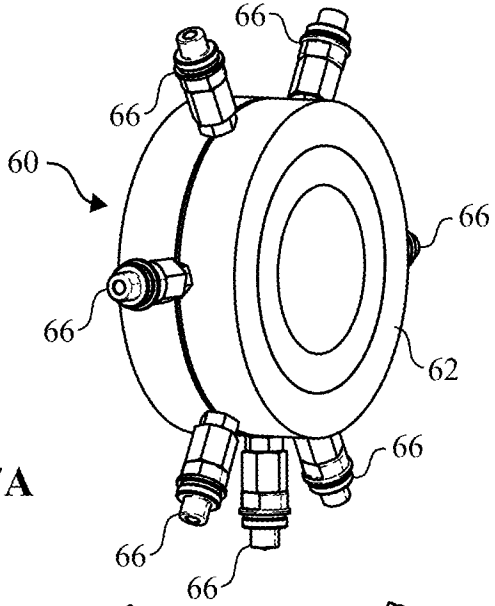
Figure 17B:
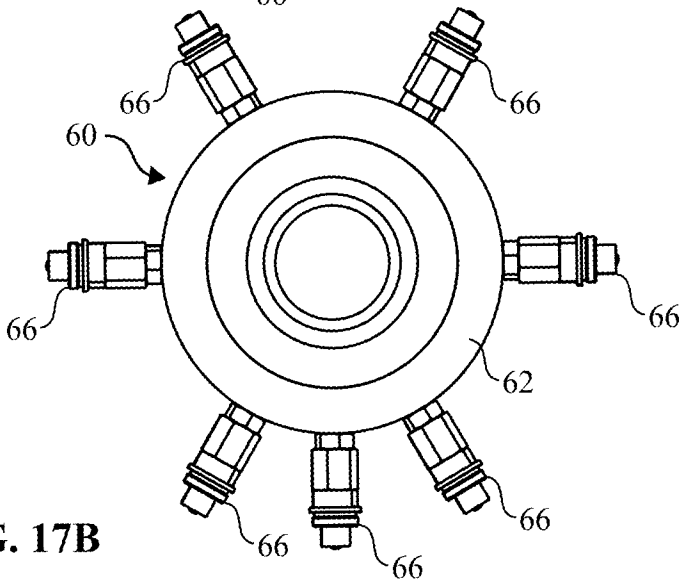

As shown in FIG. 16, a control valve 58 is coupled between the hydraulic cylinders 44, the hydraulic pump 40, and the hydraulic fluid reservoir 56. As can be appreciated by one skilled in the art, when the control valve 58 is in its driving position as shown (connecting the pump 40 to hydraulic conduit coupling 52*a* and hydraulic conduit coupling 52*b* to the reservoir 56), the pistons of the hydraulic cylinders 44 are actuated for driving side wall 16*a* towards side wall 16*b*. When the control valve 58 is placed in its retracting position (connecting pump 40 to hydraulic conduit coupling 52*b* and hydraulic conduit coupling 52*a* to the reservoir 56), the pistons of the hydraulic cylinders 44 are retracted away from side wall 16*a*.

Preferably, the drive system 18 further includes a pair of hydraulic manifolds 60*a*, 60*b* which can be mounted on a manifold support tube 82 that is slidably received into the hub tube bore 28*b*. As shown in FIGS. 17A-D, the hydraulic manifolds 60*a*, 60*b* comprise an annular manifold body 62 having an internal hydraulic fluid receiving channel 64 and a plurality of manifold couplings 66 which are mounted to the body 62 and are in fluid communication with the channel 64. As diagrammatically depicted in FIG. 16, the manifold couplings 66 of hydraulic manifold 60*a* are coupled to the cylinder hydraulic conduit couplings 52*a* by hydraulic conduits 54*a* and the manifold couplings 66 of hydraulic manifold 60*b* are coupled to the cylinder hydraulic conduit couplings 52*b* by hydraulic conduits 54*b*.

In use, the hydraulic manifolds 60*a*, 60*b* are configured to distribute hydraulic pressure evenly between the hydraulic cylinders 44 such that the clamping forces F1, F2 applied by the machine 10 to the telescoped coil 12 are applied evenly across the face plates 26. More particularly, when the drive system 18 is activated for driving the side walls 16*a*, 16*b* against the sides of the telescoped coil 12 and thereby longitudinally compressing and "untelescoping" the telescoped coil 12, the telescoped coil wraps 14 frictionally engage and slide against the adjacent coil wraps 14. The friction between the coil wraps 14 is not uniform, and so, the portion of the coil wrap 14 that is experiencing the least amount of friction will be the first portion to shift.

Figure 18:
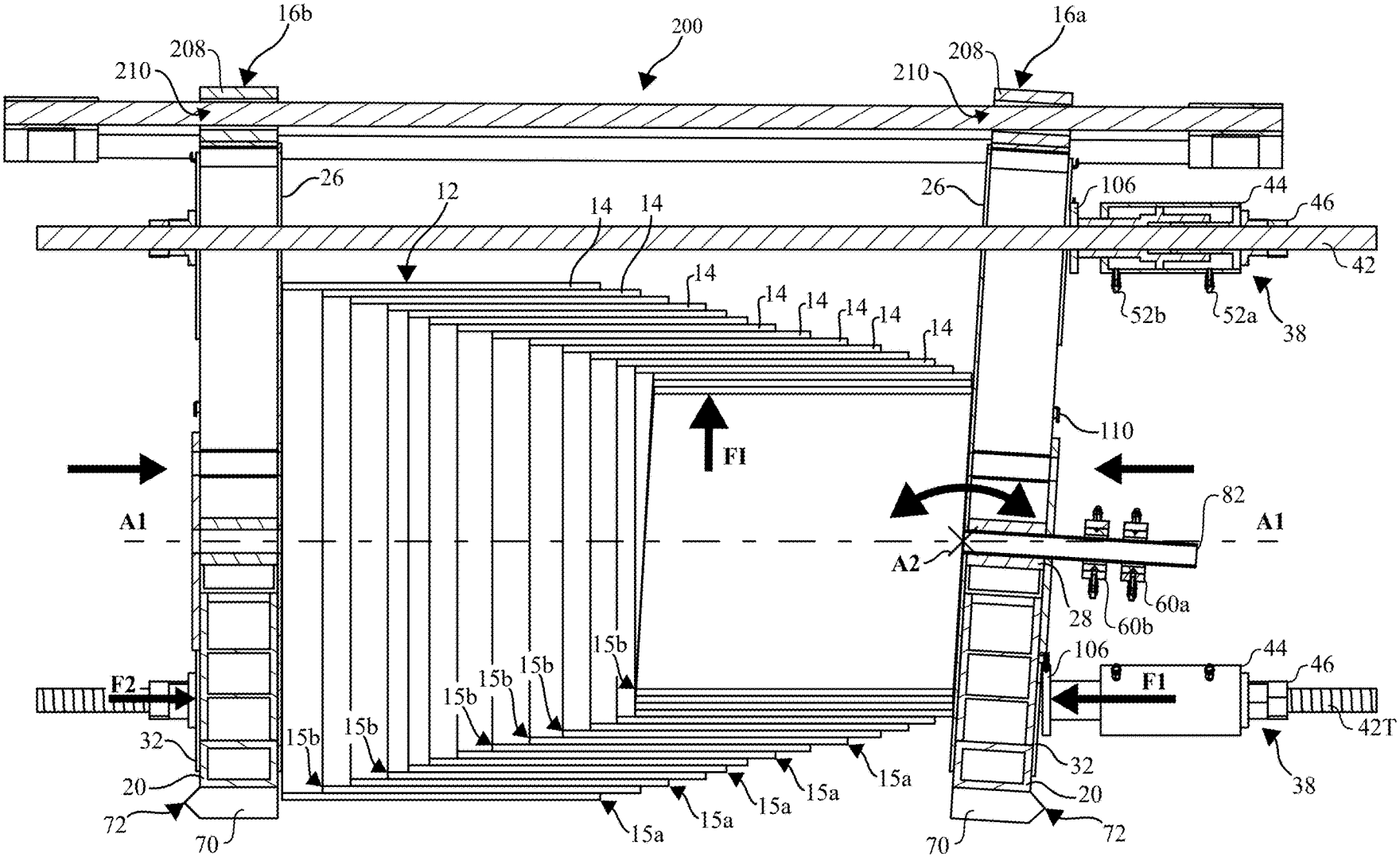
FIG. 18 is a cross-section view taken along the line 14-14 wherein the machine is shown partially longitudinally compressing a coil.

The differing amounts of friction between the coil wraps 14 are experienced by the face plates 26 as a non-uniform distributed load. Distributing hydraulic pressure evenly between the hydraulic cylinders 44 allows the hydraulic cylinders 44 to react to this non-uniform, distributed load by extending at differing rates depending on the portion of the load experienced by each cylinder 44. This in turn causes the side wall 16*a* to pivot slightly about an axis A2 extending generally perpendicular to the coil longitudinal axis A1 (for example, as shown in FIG. 18) such that the clamping forces F1, F2 applied by the machine 10 are applied evenly across the face plates 26.

As best seen in FIGS. 12 and 15, the adjustable stop pieces 46 can be a pair of nuts 46*a*, 46*b* which are adapted to thread onto the frame coupler rods 42. Nuts 46*a* preferably include annular, force distributing abutment flanges 68 and are configured to be threaded onto and rotatingly advanced along the frame coupler rods 42 until the force distributing abutment flanges 68 abut against either a pair of piston abutment plates 32 or the housing 48 of a hydraulic cylinder 44. Nuts 46*b* are threaded onto rods 42 behind the nuts 46*a* and are configured to be rotatingly tightened and clamped against nuts 46*a* for jamming and locking the nuts 46*a*, 46*b* in place relative to the frame coupler rods 42.

During assembly, the frame coupler rods 42 are inserted through the frame slots 30/window openings 36 and are configured to extend beyond the side walls 16*a*, 16*b* on both sides of the machine 10. As mentioned above, the hydraulic cylinders 44 are slidably mounted on the frame coupler rods 42 with the pistons 50 engaging and abutting against the piston abutment plates 32 of a side wall 16. In the present exemplary embodiment, the hydraulic cylinders 44 are installed on one side of the machine 10 with the pistons 50 engaging and abutting against the piston abutment plates 32 of side wall 16*a*. It should be understood, however, that hydraulic cylinders 44 can be mounted on either or both sides of the machine 10 as may be necessary or desirable.

Once the hydraulic cylinders 44 are installed, nuts 46*a* are threaded onto both terminal ends of the frame coupler rods 42. The nuts 46*a* threaded onto the frame coupler rods 42 behind the hydraulic cylinders 44 are rotatingly advanced along frame coupler rods 42 until the annular abutment flanges 68 engage and abut against the hydraulic cylinder housings 48. The nuts 46*a* threaded onto the frame coupler rods 42 adjacent to side wall 16*b* are rotatingly advanced along frame coupler rods 42 until the annular abutment flanges 68 engage and abut against the piston abutment plates 32 of side wall 16*b*. Nuts 46*b* are then threaded onto both ends of the frame coupler rods 42 and are rotatingly tightened and clamped against the nuts 46*a* for locking the nuts 46*a*, 46*b* in place. As should now be appreciated, the side walls 16*a*, 16*b* and the hydraulic cylinders 44 are sandwiched between pairs of nuts 46*a*, 46*b*.

When the drive system 18 is activated, hydraulic fluid is pumped to the hydraulic cylinders 44 for driving side wall 16*a* towards side wall 16*b* and/or pulling side wall 16*b* towards side wall 16*a*. Specifically, as hydraulic fluid is pumped to the hydraulic cylinders 44, the pistons 50 extend and the hydraulic cylinders 44 generate a pair of opposing forces F1, F2. As illustrated in FIGS. 15 and 16, force F1 is transferred to side wall 16*a* through the pistons 50 and the abutment plates 32 and force F2 is transferred to side wall 16*b* through the housings 48, the pairs of nuts 46*a*, 46*b* abutting against the housings 48, the frame coupler rods 42 (which are placed under tension), and the pairs of nuts 46*a*, 46*b* abutting against the abutment plates 32 of side wall 16*b*.

In operation, the side wall 16*a*, 16*b* which is experiencing the least friction with the ground will be driven or pulled towards the other. For example, if side wall 16*a* is experiencing less friction forces, side wall 16*a* will be driven towards side wall 16*b*. Conversely, if side wall 16*b* is experiencing less friction forces, side wall 16*b* will be pulled towards side wall 16*a*. Of course, the amount of friction experienced by the side walls 16*a*, 16*b* can change depending on a number of different factors including, for example, the condition and type of terrain over which the side walls 16*a*, 16*b* are being driven or pulled.

Referring now to FIGS. 14-16 and 18-21, as mentioned above, the machine 10 is operated by placing a telescoped coil 12 between the side walls 16*a*, 16*b* and activating the drive system 18 for selectively driving and clamping the side walls 16*a*, 16*b* against the sides of the coil 12. Specifically, the side walls 16*a*, 16*b* are spaced a horizontal distance X apart from each other. The distance X is configured to be greater than the longitudinal length Y of the telescoped coil 12 such that the coil can be placed between the side walls 16*a*, 16*b* with the terminal end side edges 15*a*, 15*b* of the coil wraps 14 facing towards the side walls 16*a*, 16*b*, respectively.

When the drive system 18 is engaged and the side walls 16*a*, 16*b* are driven or pulled towards each other, the coil engaging surfaces 34 traverse towards and are clamped and driven against the coil wrap terminal end side edges 15*a*, 15*b* whereby the forces F1, F2 are transferred to the coil wraps 14 through the coil engaging surfaces 34. Forces F1, F2 cause the coil wraps 14 to shift and slide against each other towards the opposite side walls 16*a*, 16*b* whereby the telescoped coil 12 compresses along its longitudinal axis A1. That is, the side walls 16*a*, 16*b* act like the jaws of a vice whereby driving the side walls 16*a*, 16*b* towards each other and driving the coil engaging surfaces 34 against terminal end side edges 15*a*, 15*b* compresses the coil 12 along its longitudinal axis A1 and slidingly presses the coil wraps 14 into alignment with each other. The coil 12 is, hence, "untelescoped" by continuing to drive the side walls 16*a*, 16*b* towards each other and thereby longitudinally compress the coil 12 until the respective terminal end side edges 15*a*, 15*b* of the coil wraps 14 are substantially flush or coplanar with each other.

Figure 14:
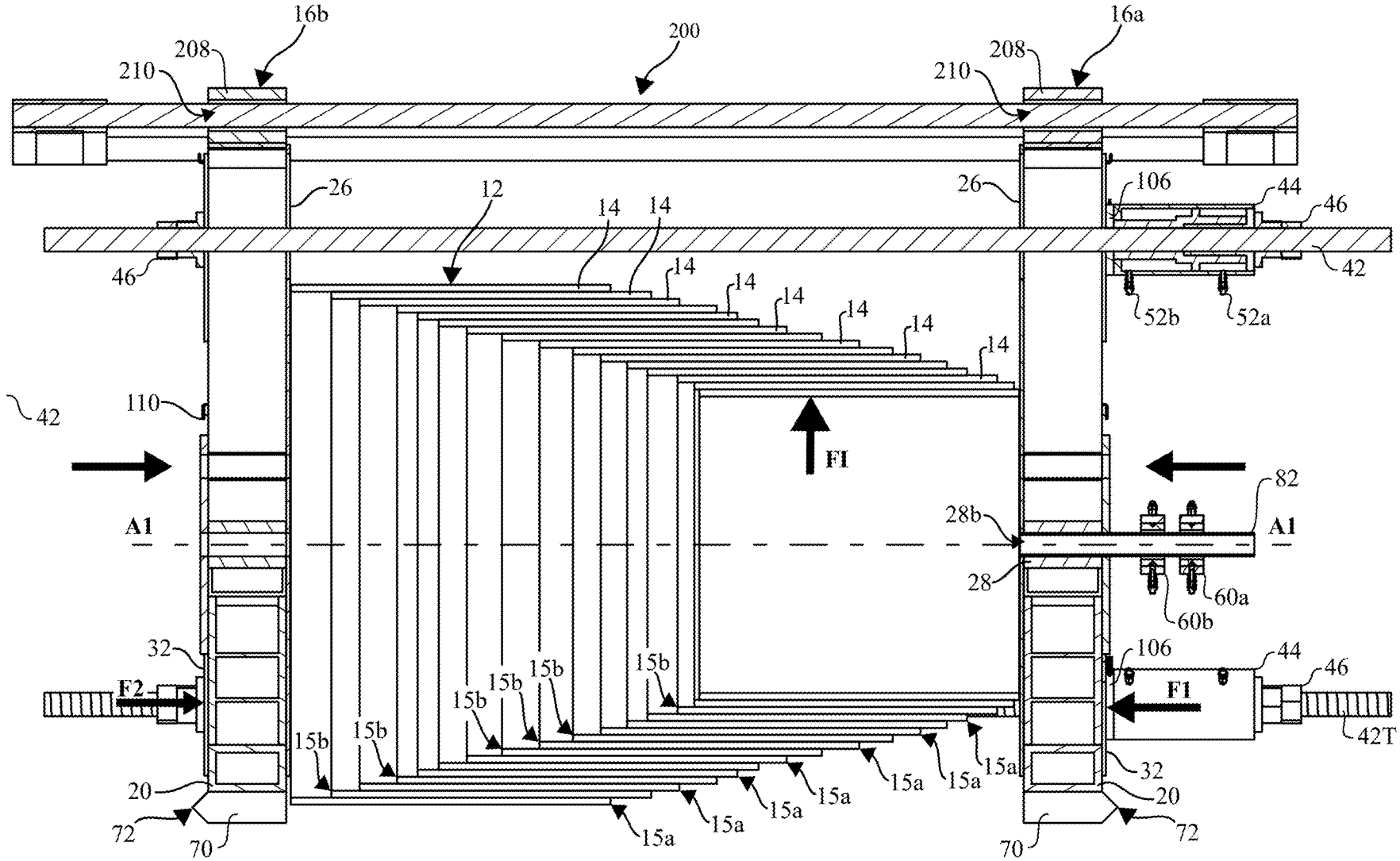
FIG. 14 is a cross-section view of the machine taken along the line 14-14 shown in FIG. 13.
Figure 19:
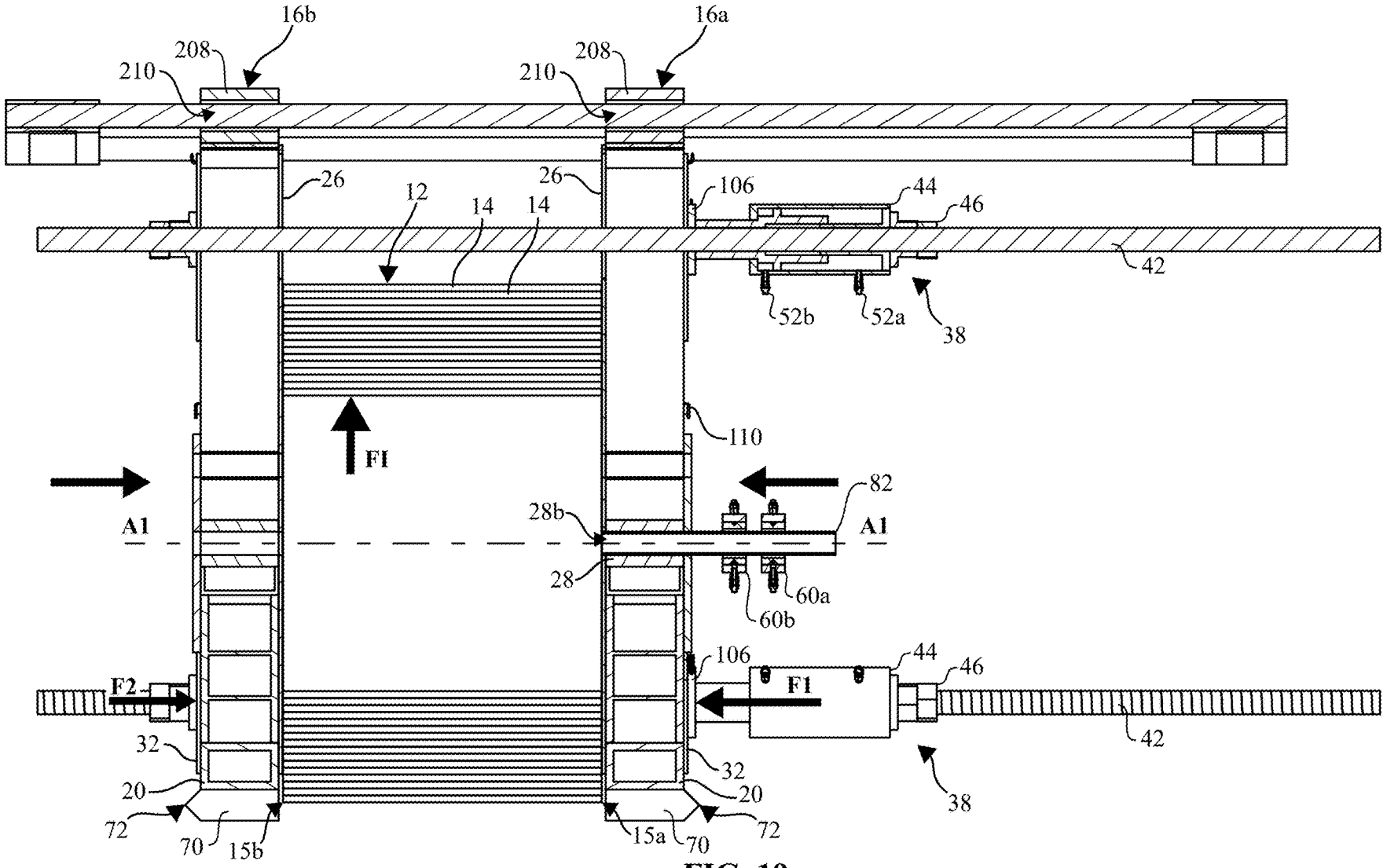
FIG. 19 is a cross-section view taken along the line 14-14 wherein the machine is shown fully longitudinally compressing a coil.

For example, FIG. 5 shows a coil 12 having inner wraps 14 which have shifted/telescoped and are protruding longitudinally from the right side of the coil 12. When the drive system 18 is activated, the coil engaging surface 34 of the right-side side wall 16*a* engages the right-side edges 15*a* of the inner wraps 14 (FIGS. 14 and 16). Similarly, the coil engaging surface 34 of the left-side side wall 16*b* engages the left-side edges 15*b* of the outer wraps 14. As the drive system 18 drives the side walls 16*a*, 16*b* towards each other, the coil wraps 14 shift and slide against each other and the coil 12 compresses along its longitudinal axis A1. The machine 10 is configured to continue driving the side walls 16*a*, 16*b* towards each other until the respective right and left-side edges 15*a*, 15*b* of each wrap 14 are substantially flush or coplanar with the right and left-side edges 15*a*, 15*b* of the other wraps 14 (FIG. 19).

Additionally, as the telescoped coil wraps 14 are longitudinally compressed, the machine 10 is configured such that the side walls 16*a*, 16*b* twist and rotate about the coil longitudinal axis A1 to allow the telescoped coil wraps 14 to twist and rewind. More particularly, as mentioned above, when sheet materials, and in particular high-tensile strength sheet materials such as, for example, sheet steel and sheet aluminum, are wound into coils 12, the wraps 14 of the coil 12 are subjected to internal compressive and tensile/expansive forces FI which resist the bending deformation of the sheet material. These internal forces FI cause the inner coil wraps 14 to drive radially outwardly against the adjacent surrounding wraps 14.

When the coil wraps 14 telescope and unravel into a helical shape, the internal forces FI continue to drive the telescoped wraps 14 radially outwardly against the adjacent surrounding wraps 14. This causes the telescoped wraps 14 to unwind relative to the coil longitudinal axis A1 and slide against the adjacent surrounding wraps 14 whereby the coil wraps 14 remain tightly overlapping and abutting against each other. When the telescoped coil 12 is thereafter longitudinally compressed, the unwound/telescoped coil wraps 14 frictionally engage the adjacent surrounding wraps 14 and slide/coil radially inwardly whereby the unwound/telescoped coil wraps 14 twist and rewind.

For example, as illustrated in FIGS. 3 and 4, the untelescoped coil 12 has wraps 14 which are wound in a clockwise direction around the coil longitudinal axis A1. As the inner wraps 14 of the coil 12 unravel and telescope, they unwind in a counterclockwise direction relative to the coil longitudinal axis A1 (see FIG. 6) and slide against the adjacent surrounding wraps 14 whereby the coil wraps 14 remain tightly overlapping and abutting against each other. When the telescoped coil 12 is thereafter longitudinally compressed, the unwound/telescoped inner coil wraps 14 frictionally engage the adjacent, surrounding outer coil wraps 14 and slide and coil radially inwardly whereby the inner coil wraps 14 twist and rewind in the clockwise direction towards their original, untelescoped shape.

In this regard, the side walls 16*a*, 16*b* are configured to twist and rotate together with coil wraps 14 to thereby allow the coil wraps 14 to retwist and rewind. Specifically, as mentioned above, the frame coupler rods 42 are configured to be loosely received through the frame slots 30/window openings 36 such that the side walls 16*a*, 16*b* are able to move independently and twist relative to each other, for example, as shown in FIG. 21. When the inner coil wraps 14 twist and rewind, they apply a torque T1 to the side walls 16*a*, 16*b* through friction between the side wall coil engaging surfaces 34 and the coil wraps/layer terminal end side edges 15*a*, 15*b*. Torque T1 causes the side walls 16*a*, 16*b* to twist about the coil longitudinal axis A1 together with coil wraps 14 which reduces the pressure, and, hence, the friction, between adjacent coil wraps 14 and thereby reduces scraping, scratching, marring, and other damage to the surfaces of the coil wraps 14 as they slide against each other.

In some cases, the telescoped coil 12 may need to be longitudinally compressed a distance greater than the stroke length of the hydraulic cylinder 44 (i.e., the maximum distance the piston 50 can extend from the housing 48). For example, in FIG. 14 the telescoped coil 12 has a longitudinal length Y and must be compressed a distance Z to be "untelescoped." The hydraulic cylinders 44 have a stroke length X which is less than the distance Z. Accordingly, after a first cycle wherein the pistons 50 are fully extended, the control valve 58 is switched to the retracting position and the hydraulic pump 40 is activated for thereby retracting the pistons 50 away from side wall 16*a*.

The hydraulic cylinders 44 are then slidingly advanced along the frame coupler rods 42 and repositioned with the pistons 50 abutting against the piston abutment plates 32, and the nuts 46*a*, 46*b* are repositioned to sandwich the hydraulic cylinders 44 against the side wall 16*a*. Once the hydraulic cylinder 44 and nuts 46*a*, 46*b* have been repositioned, the control valve 58 is switched to the driving position and the hydraulic pump 40 is reengaged for driving the side walls 16*a*, 16*b* towards each other and compressing the telescoped coil 12 therebetween. This process can then be repeated as many times as necessary to fully compress and untelescope the coil 12.

Figure 2:
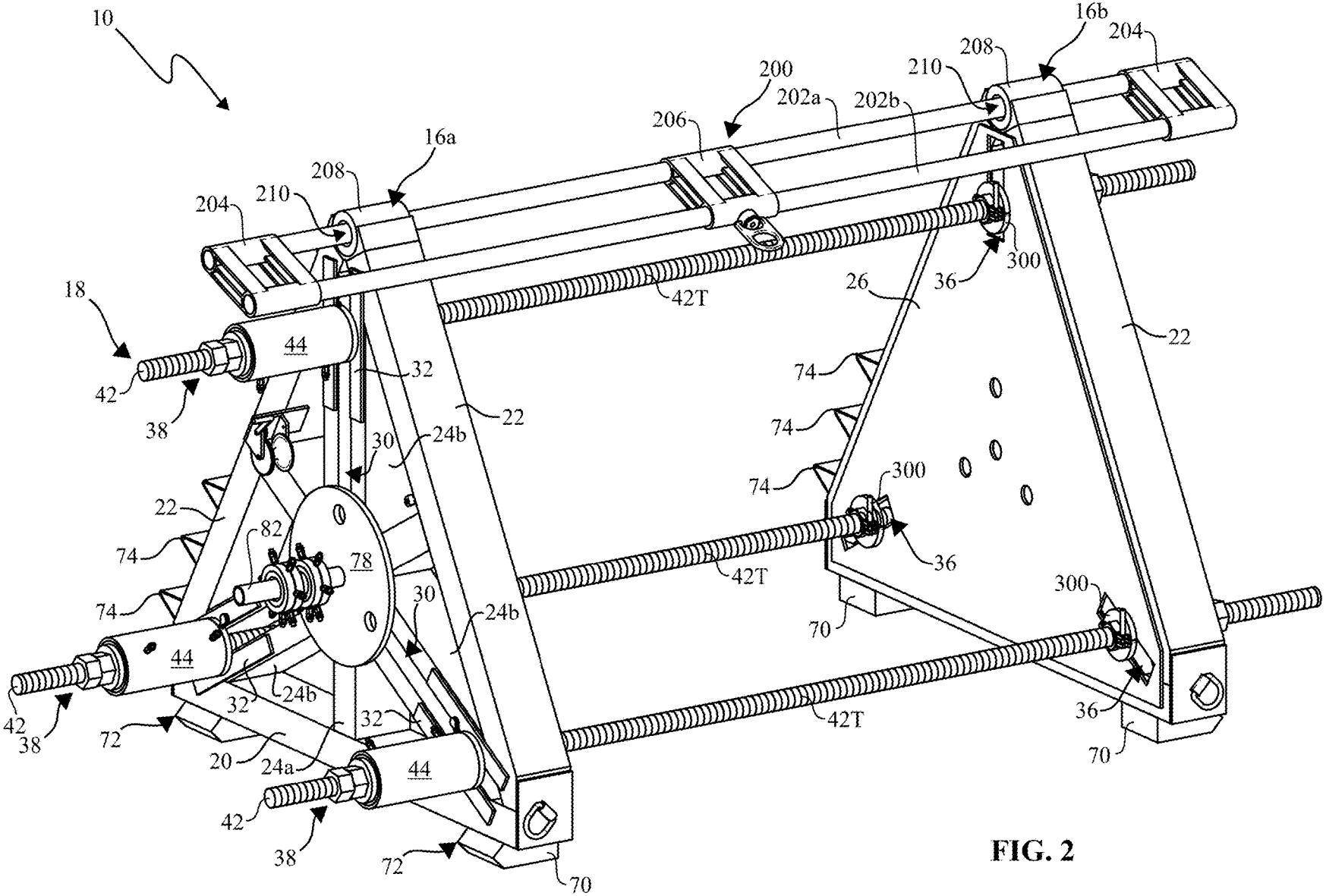
FIG. 2 is another perspective view of the machine.
Figure 26:
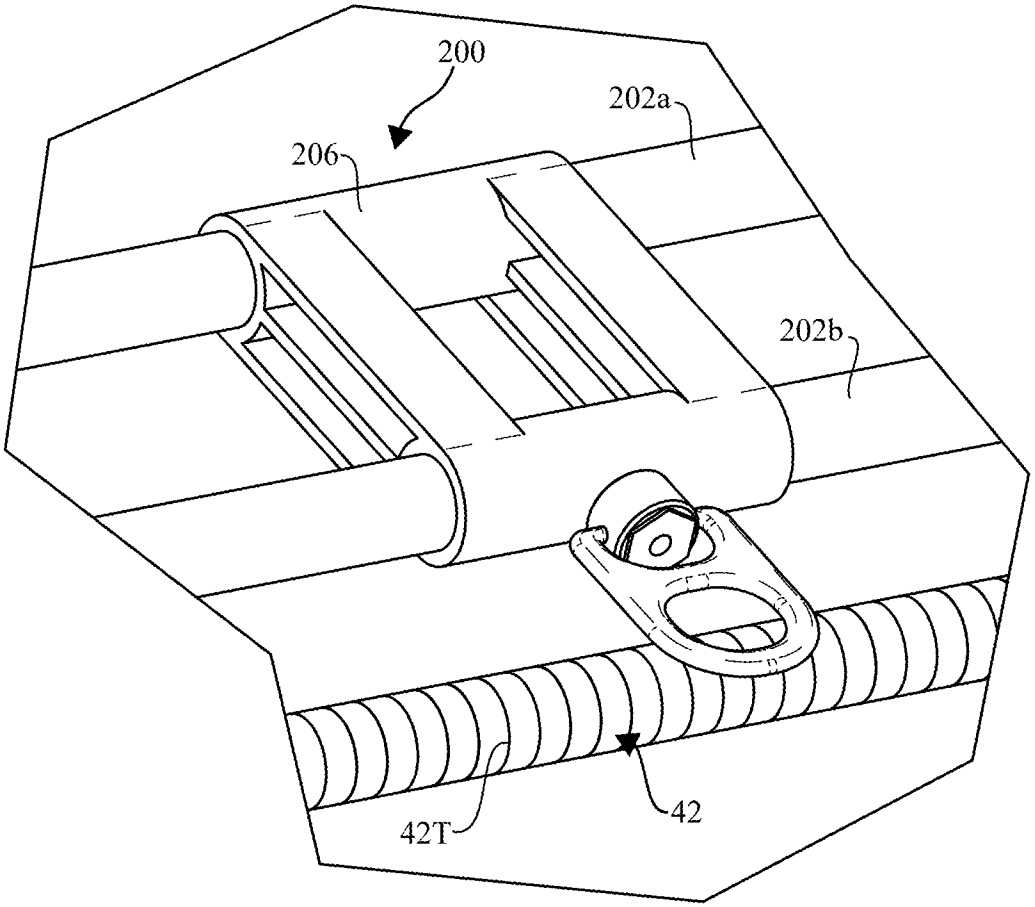
FIG. 26 is a magnified detail view of Circled Detail 26 in FIG. 2 showing the center coupler bracket of the crane/lift engaging coupler assembly.
Figure 27B:
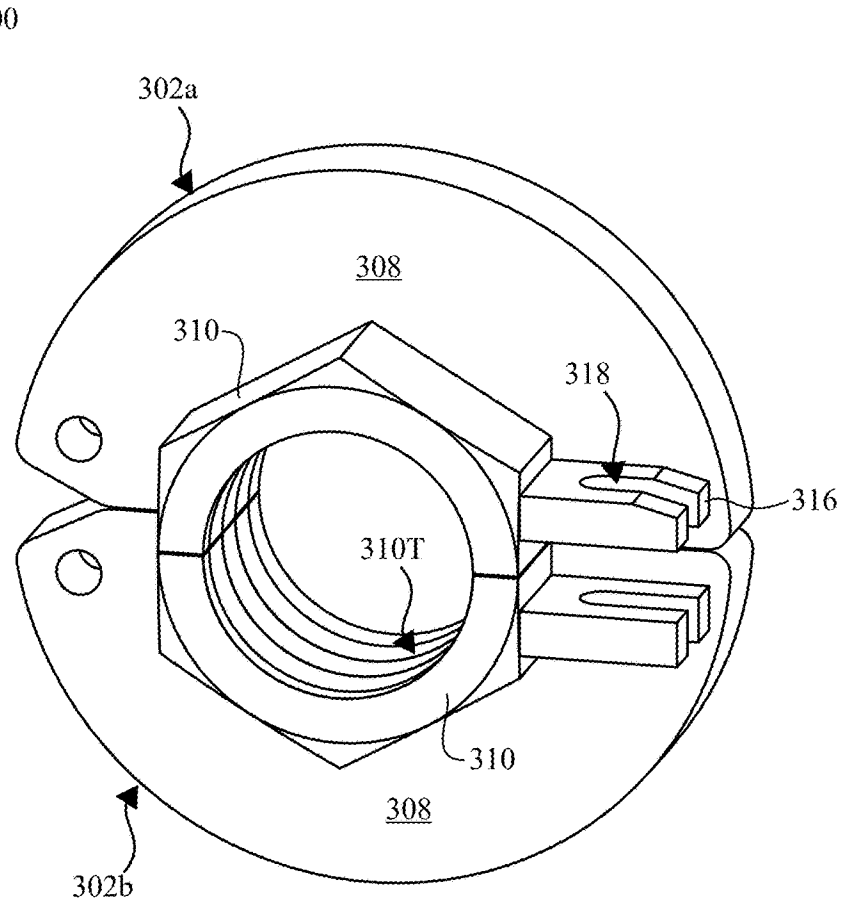
FIGS. 27A-B are perspective views of a quick-release clasp shown in FIG. 23.
Figure 27A:
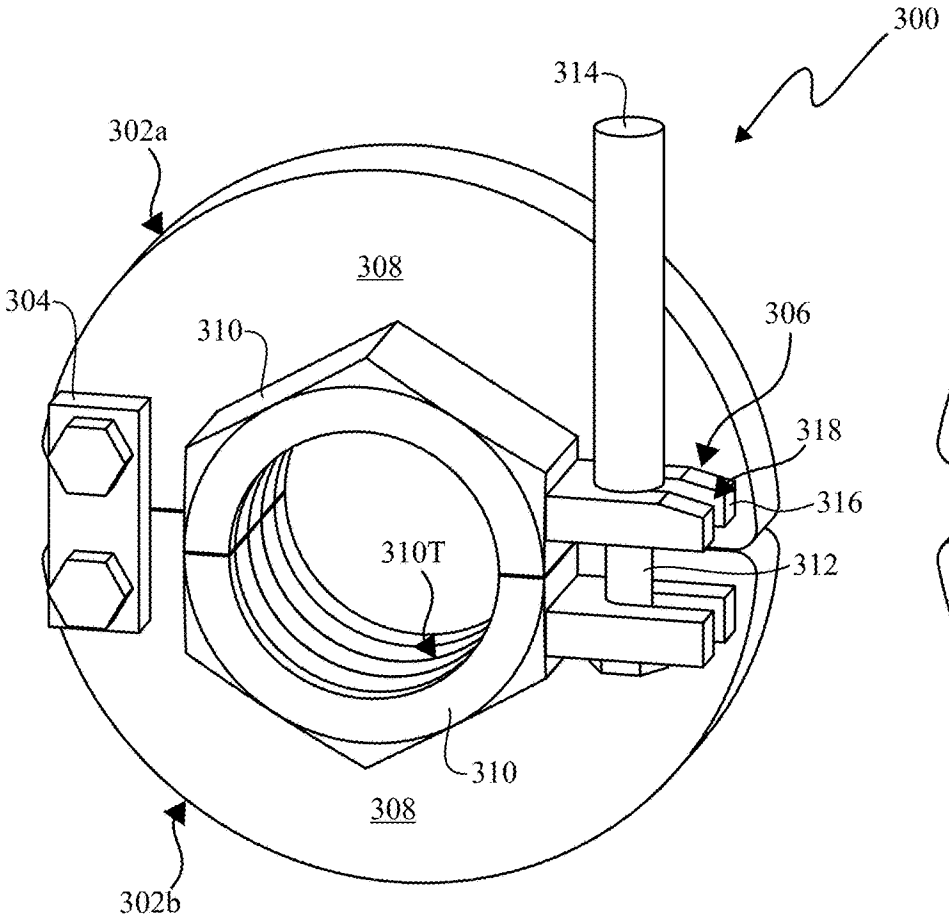
Figure 28B:
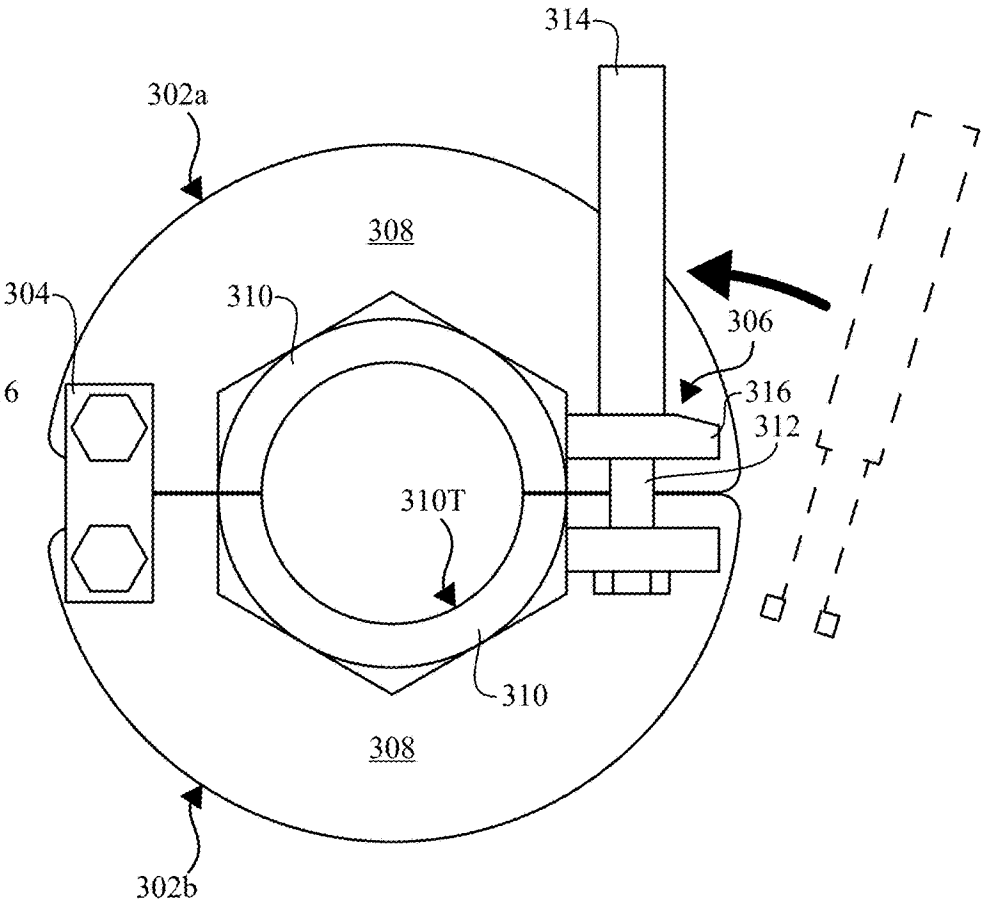
FIGS. 28A-B are side elevation views of the quick-release clasp shown in FIGS. 27A-B.
Figure 28A:
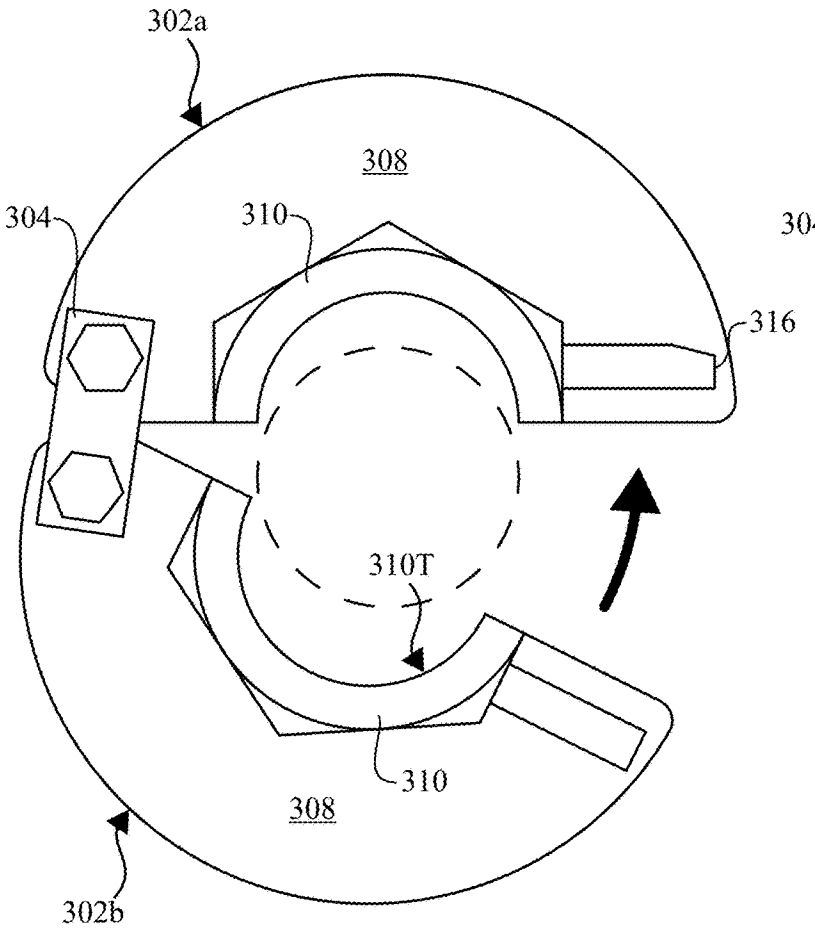

Preferably, the machine 10 is portable and can be transported to a telescoped coil 12 using a crane or lift (not shown). More particularly, as mentioned above, the machine 10 includes a crane/lift engaging coupler assembly 200. As best seen in FIGS. 2 and 26, the crane/lift engaging coupler assembly 200 comprises a pair of longitudinal coupler shafts 202*a*, 202*b* which are coupled together by a pair of end brackets 204 and a center coupler bracket 206. The crane/lift engaging coupler assembly 200 is mounted to the side walls 16*a*, 16*b* by slidingly receiving coupler shaft 202*a* through the central bores 210 of crane/lift coupler mounts 208 which are secured at the upper ends of the side walls 16*a*, 16*b* between the ends of the legs 22. The end brackets 204 are mounted to the ends of the shafts 202*a*, 202*b* one on either side of the machine 10 and prevent coupler shaft 202*a* from sliding out of the coupler mount central bores 210. The center coupler bracket 206 is mounted at the longitudinal center of the shafts 202*a*, 202*b* and includes a pivotable coupling 52 which is configured to be coupled to crane or lift (not shown) for lifting and transporting the machine 10.

The machine 10 preferably also includes a plurality of quick-release clasps 300. The quick-release clasps 300 are configured to clasp around the frame coupler rods 42 of the drive system actuator assemblies 38 adjacent to and/or abutting against the side walls 16*a*, 16*b* and are configured to prevent the side walls 16*a*, 16*b* from sliding along the rods 42 during transportation of the machine 10. As best seen in FIGS. 27A-B and 28A-B, the quick-release clasps 300 comprise two clasp halves 302*a*, 302*b* which are pivotably coupled together by a pivot assembly 304 and are locked around a frame coupler rod 42 by a locking mechanism 306. Each clasp half 302*a*, 302*b* includes a semi-circular support wall 308 and a half nut 310 which is secured to the support wall 308. The half nuts 310 include internal threads 310T which are configured to engage the external threads 42T of the frame coupler rods 42.

The locking mechanism 306 includes a shaft 312 which is pivotably mounted to clasp half 302*a* and a handle 314 which extends longitudinally from the end of the shaft 312. The shaft 312 is configured to slot into a groove 318 formed in a shelf 316 which extends from the half nut 310 of clasp half 302*b*. When the shaft 312 is slotted into the groove 318, the handle 314 is captured on the opposite side the shelf 316 for thereby locking the quick-release clasp 300 closed.

In use, the quick-release clasps 300 are placed around the frame coupler rods 42 with the internal threads 310T of the half nuts 310 threadingly engaging the coupler rod external threads 42T and the support walls 308 adjacent to and/or abutting against the side walls 16*a*, 16*b*. The quick-release clasps 300 are then locked closed by slotting the shafts 312 into the grooves 318. As the machine 10 is lifted and transported using the crane/lift engaging coupler assembly 200, the engagement between the half nut internal threads 310T and the coupler rod external threads 42T prevents the quick-release clasps 300, and, hence, the side walls 16*a*, 16*b*, from sliding along the frame coupler rods 42.

While this invention has been described as having an exemplary design, the present invention may be further modified within the spirit and scope of this disclosure. For example, the side walls 16*a*, 16*b* are shown and described as A-frame structures. However, it should be understood that the side walls 16*a*, 16*b* can be formed in a variety of different shapes and configurations as may be necessary or desirable. For example, the side walls 16*a*, 16*b* can also be square or rectangular-frame structures, circular-frame structures, or solid plate/wall structures. This application is therefore intended to cover any variations, uses, or adaptations of the invention using its general principles.

What is claimed is:

1. A machine for untelescoping a coil of sheet material, the coil of sheet material comprising a plurality of wraps which are wound in concentric spirals around a central longitudinal axis, wherein one or more of the coil wraps have unraveled in a direction along the central longitudinal axis, the machine comprising:

a first side wall;

a second side wall disposed a distance from the first side wall, wherein the coil is received between the first and second side walls; and one or more linear actuators adapted for selectively driving one of the first and second side walls towards the other and thereby compressing the coil along its central longitudinal axis between the first and second side walls;

wherein as the coil is compressed along its central longitudinal axis, the unraveled coil wraps twist about the central longitudinal axis and coil radially inwardly; and wherein one or both of the first and second side walls twist about the central longitudinal axis together with the unraveled coil wraps.

2. The machine of claim 1, wherein the one or more linear actuators are coupled to the first and second side walls.

3. The machine of claim 1, wherein the one or more linear actuators are hydraulic cylinders.

4. The machine of claim 1, wherein the one or more linear actuators comprise hollow hydraulic cylinders which are slidably mounted on rods, and wherein the rods extend between and couple the first and second side walls together.

5. The machine of claim 4, wherein the first and second side walls include one or more window openings, and wherein the rods are slidably received through the window openings for coupling the first and second side walls together.

6. The machine of claim 1, wherein the first and second side walls comprise planar face plates constructed from a high-strength, abrasion resistant material, and wherein the planar face plates engage the coil.

7. The machine of claim 1, wherein the first and second side walls are frameworks comprising a plurality of tubular members and a planar face plate mounted to one or more of the tubular members.

8. The machine of claim 7, wherein one or more of the tubular members includes one or more internal ribs for reinforcing and increasing the rigidity of said tubular member.

9. The machine of claim 7, wherein the planar face plates include one or more window openings, wherein the one or more linear actuators comprise hollow hydraulic cylinders which are slidably mounted on rods, and wherein the rods are slidably received through the window openings.

10. The machine of claim 1, wherein the machine comprises two or more linear actuators.

11. The machine of claim 10, wherein the two or more linear actuators each provide an equal amount of force for driving one of the first and second side walls towards the other, and wherein the two or more linear actuators can extend at differing rates.

12. The machine of claim 10, wherein the linear actuators are hydraulic cylinders, wherein the machine further comprises one or more hydraulic manifolds, and wherein the hydraulic manifolds are coupled between the hydraulic cylinders and a hydraulic power source for distributing hydraulic fluid and hydraulic pressure between the hydraulic cylinders.

13. The machine of claim 12, wherein hydraulic fluid and hydraulic pressure is distributed evenly between the hydraulic cylinders.

14. The machine of claim 1, wherein the one or more linear actuators are positioned relative to one or both of the first and second side walls, and wherein the position of the one or more linear actuators is selectively adjustable.

15. The machine of claim 14 further comprising one or more winches mounted to one or both of the first and second side walls, wherein the one or more winches are coupled to one or more of the linear actuators, and wherein the positions of the linear actuators are selectively adjusted using the winches.

16. The machine of claim 1, wherein the first side walls includes one or more feet which support the first side wall above the ground, and wherein the one or more feet are slidable along the ground for allowing the first side wall to slide towards the second side wall.

17. The machine of claim 1, wherein the second side wall includes one or more feet which support the second side wall above the ground, and wherein the one or more feet are slidable along the ground for allowing the second side wall to slide towards the first side wall.

18. The machine of claim 1, wherein both of the first and second side walls include one or more feet which support the first and second side walls, respectively, above the ground, and wherein the one or more feet are slidable along the ground for allowing the first and second side walls to slide towards each other.

19. A method for untelescoping a coil of sheet material, the coil of sheet material comprising a plurality of wraps which are wound in concentric spirals around a central longitudinal axis, wherein one or more of the coil wraps have unraveled in a direction along the central longitudinal axis, the method comprising the steps of:

compressing the coil along its central longitudinal axis between a first side wall and a second side wall;

wherein during the step of compressing, the unraveled coil wraps twist about the central longitudinal axis and coil radially inwardly and one or both of the first and second side walls twist about the central longitudinal axis together with the unraveled coil wraps.

20. The method of claim 19, wherein during the step of compressing, one or both of the first and second side walls pivot relative to one or more axes extending generally perpendicular to the central longitudinal axis.

* * * * *